US010919673B2

(12) United States Patent
Luburic et al.

(10) Patent No.: US 10,919,673 B2
(45) Date of Patent: Feb. 16, 2021

(54) CONTAINER AND CONTAINER LID WITH BUILT-IN BRINE DISC

(71) Applicant: BWAY Corporation, Atlanta, GA (US)

(72) Inventors: Frano Luburic, Costa Mesa, CA (US); Christopher James Lung, Santa Ana, CA (US)

(73) Assignee: BWAY Corporation, Atlanta, GA (US)

( * ) Notice: Subject to any disclaimer, the term of this patent is extended or adjusted under 35 U.S.C. 154(b) by 70 days.

(21) Appl. No.: 16/245,105

(22) Filed: Jan. 10, 2019

(65) Prior Publication Data

US 2019/0210771 A1 Jul. 11, 2019

Related U.S. Application Data

(60) Provisional application No. 62/615,688, filed on Jan. 10, 2018.

(51) Int. Cl.
*B65D 43/02* (2006.01)
*B65D 41/16* (2006.01)
(Continued)

(52) U.S. Cl.
CPC ..... *B65D 43/0256* (2013.01); *B65D 21/0217* (2013.01); *B65D 21/0219* (2013.01);
(Continued)

(58) Field of Classification Search
CPC ..... B65D 23/065; B65D 23/06; B65D 47/40; B65D 43/0256; B65D 43/0249; B65D 21/0219; B65D 21/0217; B65D 41/165; B65D 41/005; B65D 2543/0074; B65D 2543/00805; B65D 2543/00629; B65D 2543/005; B65D 2543/00194; B65D 2543/00685; B65D 2543/00027; B65D 2543/00518; B65D 2543/00555;
(Continued)

(56) References Cited

U.S. PATENT DOCUMENTS 2,313,845 A * 3/1943 Sundholm ..... G01F 13/00 222/387
2,844,276 A 7/1958 Dimmock
(Continued)

OTHER PUBLICATIONS

Gamma Seal Lid: http://www.urbanhomemaker.com/productcart/pc/viewPrd.asp?idproduct=1353, retrieved Jun. 1, 2017 (2 pages).

*Primary Examiner* — Kareen K Thomas
(74) *Attorney, Agent, or Firm* — Morris, Manning & Martin, LLP; Daniel E. Sineway, Esq.; Bryan D. Stewart, Esq.

(57) ABSTRACT

The present disclosure relates generally to containers and container lids. In at least one embodiment, the disclosed containers and container lids provide a liquid-tight seal without the use of gaskets, and can facilitate full submersion of solid items when the container is filled with liquid. For example, in certain embodiments, a container lid includes a brine disc panel with alternating hatched patterns of downward protruding ridges. Thus, in these embodiments, liquids within the container can pass between the protruding ridges (e.g., with the protruding ridges extending downwardly into the liquid) and the protruding ridges may keep solids that tend to float in the liquid below a surface of the liquid.

17 Claims, 32 Drawing Sheets

(51) Int. Cl.
*B65D 41/00* (2006.01)
*B65D 21/02* (2006.01)

(52) U.S. Cl.
CPC ..... *B65D 41/005* (2013.01); *B65D 41/165* (2013.01); *B65D 43/0249* (2013.01); *B65D 2543/005* (2013.01); *B65D 2543/00027* (2013.01); *B65D 2543/0074* (2013.01); *B65D 2543/00092* (2013.01); *B65D 2543/00194* (2013.01); *B65D 2543/00296* (2013.01); *B65D 2543/00398* (2013.01); *B65D 2543/00518* (2013.01); *B65D 2543/00555* (2013.01); *B65D 2543/00629* (2013.01); *B65D 2543/00685* (2013.01); *B65D 2543/00805* (2013.01)

(58) Field of Classification Search
CPC ..... B65D 2543/00398; B65D 2543/00296; B65D 2543/00092; B65D 83/228; B65D 2577/2041; A47G 19/02; A47G 19/12; A47G 2019/145; A47J 31/4428
USPC .... 220/571, 571.1, 572, 573, 260, 265, 266, 220/268, 269; 206/469
See application file for complete search history.

(56) References Cited

U.S. PATENT DOCUMENTS 3,240,610 A * 3/1966 Cease ..... B65D 81/343 426/113
3,352,450 A * 11/1967 Rawlins ..... B44D 3/128 220/571.1
3,730,382 A 5/1973 Heisler
3,817,420 A 6/1974 Heisler
3,913,785 A 10/1975 Pattershall
3,999,677 A * 12/1976 Oberkircher ..... B29C 45/4435 220/266
4,034,889 A 7/1977 Hammes et al.
4,210,258 A 7/1980 von Holdt
4,228,916 A 10/1980 Weingardt
4,356,930 A 11/1982 Roper
4,375,265 A 3/1983 van de Wetering et al.
4,524,882 A 6/1985 Buc
4,530,442 A 7/1985 Vogel, Jr. et al.
4,560,077 A 12/1985 Dutt
4,574,974 A 3/1986 von Holdt
4,735,337 A 4/1988 von Holdt
5,096,083 A 3/1992 Shaw et al.
5,131,557 A 7/1992 Stolzman
5,730,309 A 3/1998 Jiradejnunt et al.
5,839,598 A * 11/1998 Mitchell ..... B65D 1/16 220/321
5,842,593 A 12/1998 von Holdt
6,065,628 A 5/2000 Page
6,491,185 B1 12/2002 Azzarello et al.
6,595,366 B1 7/2003 Brown
6,648,164 B1 11/2003 DeCola et al.
6,880,716 B2 4/2005 Gottainer et al.
7,475,788 B2 1/2009 Schwarz
7,963,419 B2 6/2011 Burney et al.
8,033,420 B2 * 10/2011 Roseblade ..... A47G 19/2211 220/369
8,056,758 B2 * 11/2011 Burney ..... B65D 25/32 220/269
8,091,732 B2 1/2012 Bryson et al.
8,181,819 B2 5/2012 Burney et al.
8,342,354 B2 1/2013 Letica
8,459,486 B2 6/2013 Luburic et al.
8,596,492 B2 12/2013 Lown et al.
8,863,983 B2 10/2014 Meers et al.
9,561,880 B2 * 2/2017 Luburic ..... B65D 21/0222
2002/0063134 A1 5/2002 von Holdt, Sr. et al.
2003/0015542 A1 1/2003 Nulty et al.
2003/0160051 A1 * 8/2003 Ciccone ..... B65D 43/0256 220/276
2004/0232026 A1 11/2004 Goeking et al.
2006/0163252 A1 7/2006 Zalewski
2009/0026203 A1 * 1/2009 Selina ..... B65D 43/0256 220/276
2014/0217096 A1 8/2014 Simpson

* cited by examiner

CONTAINER AND CONTAINER LID WITH BUILT-IN BRINE DISC

CROSS REFERENCE TO RELATED APPLICATIONS

This application claims priority to, the benefit under 35 U.S.C. § 119 of, and incorporates by reference herein in its entirety U.S. Provisional Patent Application No. 62/615,688, filed Jan. 10, 2018, and entitled "CONTAINER AND CONTAINER LID WITH BUILT-IN BRINE DISC."

TECHNICAL FIELD

The present disclosure relates generally to containers and container lids.

BACKGROUND

Containers and lids are a staple in today's society. Wholesalers, merchants, and individuals use containers in a plethora of industries including, but not limited to: manufacturing, agriculture, beverage, entertainment, health care, food services, hospitality, fishing, retail, automotive, transportation, waste management, oil and gas, education, and construction. These industries use containers to store and carry a wide range of substances and items that can include solids, liquids, gases, or a combination of these. Substances and items may include but are not limited to: paint, water, lubricants, integrated circuits, sauces, chemical solutions, plastic tubes, sand, powders, and even pickles.

Although common and useful, containers and lids can include inadequate sealing mechanisms that allow leakage and air intake. Including a gasket in a container and/or lid design may help eliminate leakage and inadequate air intake, but because gaskets are commonly made of rubber, paper, or cork, they can break and crack over time, which can cause them to lose sealant properties.

Further, in some applications, containers may be filled with solids submerged in a more dense liquid, which causes the solid to float above a surface of the liquid. In these scenarios, the solid may be exposed to air between a top surface of the liquid and the underside of the lid connected to the container, therefore losing the benefits of full submersion.

Therefore, there is a long-felt but unresolved need for containers and lids, wherein the containers or lids provide a seal that generally eliminates the need for gaskets, and provide a mechanism that encourages solids to remain submerged in liquids.

BRIEF SUMMARY OF DISCLOSURE

Briefly described and according to one embodiment, aspects of the present disclosure relate generally to containers and container lids, and more particularly to gasket-less containers and associated container lids that include brine disc panels. The present embodiments provide improvements over traditional containers and container lids that store solids submerged in liquids by providing a brine disc panel, wherein the underside of the container lid provides a mechanism for negating buoyancy and facilitating submersion of the solids within the liquids.

According to a first aspect, the container lid may include a seal portion along a perimeter of a body, the seal portion for receiving an edge of a container, a tear strip removeably connected to the seal portion, one or more lift tabs accessible upon removal of the tear strip, and a plurality of protrusions protruding from a bottom surface of the body to a particular depth, wherein: A) the body includes four regions defined by two perpendicular axes, each axis of the two perpendicular axes passing through a central point of the body; B) the plurality of protrusions are arranged such that at least one of the plurality of protrusions are within each of the four regions; C) each of the plurality of protrusions has a length greater than the particular depth; and D) the length of any protrusion within one of the four regions is perpendicular to the length of any protrusion within an adjacent region of the four regions.

According to a second aspect, the container lid may include the container lid of the first aspect or any other aspect, wherein each of the four regions includes at least two protrusions, the at least two protrusions in each region spaced such that a fluid can pass between the at least two protrusions.

According to a third aspect, the container lid may include the container lid of the second aspect or any other aspect, wherein a centerline along a longest portion of each protrusion of the plurality of protrusions is parallel to one of the axes.

According to a fourth aspect, the container lid may include the container lid of the first aspect or any other aspect, wherein the container lid further includes a cover panel groove defined by a top surface of the body, the cover panel groove including a sloping portion that slopes downwardly to a centerline of the cover panel groove.

According to a fifth aspect, the container lid may include the container lid of the fourth aspect or any other aspect, wherein: A) the bottom surface is at a first depth; B) a bottom surface of the cover panel groove is at a second depth; and C) the second depth is greater than the first depth.

According to a sixth aspect, the container lid may include the container lid of the fifth aspect or any other aspect, wherein the particular depth is greater than the second depth.

According to a seventh aspect, the container lid may include the container lid of the sixth aspect or any other aspect, wherein the container lid further includes one or more lead-in features, each of the one or more lead-in features including a downward slope from a top portion of the respective lead-in portion to the top surface.

According to an eighth aspect, the container lid may include the container lid of the seventh aspect or any other aspect, wherein at least a portion of one of the plurality of protrusions extends from a bottom surface of the one or more lead-in features.

According to a ninth aspect, the container lid may include the container lid of the eighth aspect or any other aspect, wherein: A) one or more protrusions of the plurality of protrusions include a sloping portion; and B) the sloping portion of the one or more protrusions and the downward slope of the one or more lead-in features are substantially similar slopes.

According to a tenth aspect, the container lid may include the container lid of the ninth aspect or any other aspect, wherein the container lid has a nesting height of about 0.75 inches.

According to an eleventh aspect, the container lid may include the container lid of the first aspect or any other aspect, wherein the seal portion includes a gasketless seal.

According to a twelfth aspect, the container lid may include the container lid of the first aspect or any other aspect, wherein the container lid is substantially circular.

According to a thirteenth aspect, the container lid may include the container lid of the first aspect or any other aspect, wherein the container lid is substantially rectangular.

According to a fourteenth aspect, the container lid may include the container lid of the thirteenth aspect or any other aspect, wherein the substantially rectangular container lid further includes a corner window, wherein the corner window is defined by the seal portion and exposes an interior area of the seal portion.

According to a fifteenth aspect, the container lid may include a body including a top surface and a bottom surface; and a plurality of protrusions protruding from the bottom surface of the body to a particular depth, wherein: A) the body includes four regions defined by two perpendicular axes, each axis of the two perpendicular axes passing through a central point of the body; B) the plurality of protrusions are arranged such that at least two of the plurality of protrusions are within each of the four regions and the at least two protrusions in each region are spaced such that a fluid can pass between the at least two protrusions; C) each of the plurality of protrusions has a length greater than the particular depth; and D) a centerline along a longest portion of each protrusion of the plurality of protrusions is parallel to one of the axes.

According to a sixteenth aspect, the container lid may include the container lid of the fifteenth aspect or any other aspect, wherein any protrusion within one of the four regions is perpendicular to any protrusion within an adjacent region of the four regions.

According to a seventeenth aspect, the container lid may include the container lid of the sixteenth aspect or any other aspect, wherein the container lid further includes: A) a seal portion along a perimeter of a body, the seal portion for receiving an edge of a container; B) a tear strip removeably connected to the seal portion; C) one or more lift tabs accessible upon removal of the tear strip; and D) a space between each of the one or more lift tabs.

According to an eighteenth aspect, the container lid may include the container lid of the seventeenth aspect or any other aspect, wherein the container lid further includes a cover panel groove defined by the top surface, the cover panel groove including a sloping portion that slopes downwardly to a centerline of the cover panel groove.

According to a nineteenth aspect, the container lid may include the container lid of the eighteenth aspect or any other aspect, wherein the container lid further includes one or more lead-in features, each of the one or more lead-in features including a downward slope from a top portion of the respective lead-in portion to the top surface.

According to a twentieth aspect, the container lid brine disc may include a plurality of ridges protruding from a bottom surface to a particular depth; and four regions defined by two perpendicular axes, each axis of the two perpendicular axes passing through a central point of the bottom surface, wherein: A) the plurality of ridges are arranged such that at least one of the plurality of ridges are within each of the four regions; B) each of the plurality of ridges has a length greater than the particular depth; and C) the length of any ridge within one of the four regions is perpendicular to the length of any ridge within an adjacent region of the four regions.

According to a twenty-first aspect, the container lid may include the container lid of the twentieth aspect or any other aspect, wherein the container lid is substantially circular.

According to a twenty-second aspect, the container lid may include the container lid of the twentieth aspect or any other aspect, wherein the container lid is substantially rectangular.

According to a twenty-third aspect, the container lid may include the container lid of any of the first through twenty-second aspects or any other aspect, wherein the four regions are quadrants.

According to a twenty-fourth aspect, the container lid may include the container lid of any of the twenty-second or twenty-third aspects or any other aspect, wherein the substantially rectangular container lid further includes a corner window, wherein the corner window is defined by the seal portion and exposes a portion of the interior of the seal portion.

According to a twenty-fifth aspect, the container lid may include the container lid of any of the twenty-second through twenty-fourth aspects or any other aspect, wherein: A) the substantially rectangular container lid includes one or more lift tabs; and B) the one or more lift tabs occupy a fraction of a corner of the seal portion.

According to a twenty-sixth aspect, the container lid may include the container lid of any of the twenty-second through twenty-fifth aspects or any other aspect, wherein: A) the substantially rectangular container lid includes one or more lift tabs; and B) the one or more lift tabs terminate prior to an apex of a corner of the seal portion According to a twenty-seventh aspect, the container lid may include a brine disk divided into four regions, the four regions defined by two perpendicular axes, each axis of the two perpendicular axes passing through a central point of the brine disk; and a plurality of protrusions protruding from a bottom surface of the brine disk to a particular depth, wherein: A) the plurality of protrusions are arranged such that at least one of the plurality of protrusions are within each of the four regions; B) each of the plurality of protrusions has a length greater than the particular depth; and C) any protrusion within one of the four regions is perpendicular to any protrusion within an adjacent region of the four regions.

According to a twenty-eighth aspect, the container lid may include a seal portion along a perimeter of a body, the seal portion for receiving an edge of a container, the seal portion including one or more lift tabs accessible upon removal of a tear strip removably connected to the seal portion and defining a space between each of the one or more lift tabs, and a brine disk including a plurality of protrusions in a hatch pattern protruding from a bottom surface of the brine disk to a particular depth.

According to a twenty-ninth aspect, the container may include a substantially rectangular bottom including substantially straight side portions and defining a groove at each of four corners, a sidewall extending upwardly from the substantially rectangular bottom, the sidewall defining an interior of the container and terminating in a gasketless pail bead with a substantially rectangular cross-sectional portion for sealing the opening with a lid without use of a gasket, a tamper evident satellite ring extending outwardly from the sidewall and below the gasketless pail bead, a nesting satellite ring extending outwardly from the sidewall and the tamper evident satellite ring, wherein: A) portions of the sidewall between the gasketless pail bead and the nesting satellite ring are corrugated; and B) the groove at each corner of the rectangular bottom extends upwardly along corners of the sidewall and terminates between the gasketless pail bead and the tamper evident satellite ring, thereby creating a ledge within the interior of the container.

According to a thirtieth aspect, the container may include the container of the twenty-ninth aspect or any other aspect, wherein the container further includes a rib extending along a portion of at least one groove between the nesting satellite ring and the gasketless pail bead.

According to a thirty-first aspect, the container may include the container of the thirtieth aspect or any other aspect, wherein the rib extends along at least one groove between the nesting satellite ring and the gasketless pail bead.

According to a thirty-second aspect, the container may include the container of any of the thirtieth or thirty-first aspects or any other aspect, wherein the rib extends along at least one groove between the tamper evident satellite ring and the gasketless pail bead.

According to a thirty-third aspect, the container may include the container of any of the twenty-ninth through thirty-second aspects or any other aspect, wherein the container further includes a bumper satellite ring extending outwardly from the sidewall and positioned between the tamper evident satellite ring and the nesting satellite ring.

According to a thirty-fourth aspect, the container may include the container of the twenty-second through thirty-third aspects or any other aspect, wherein: A) an inside surface of the sidewall terminates at a first corner of the gasketless pail bead; B) an outside surface of the sidewall forms a hook rim including a hook rim protrusion protruding outwardly from the outside surface of the sidewall; C) the outside surface of the sidewall terminates at a second corner of the gasketless pail bead; and D) the first and the second corner are connected by a portion of the sidewall that extends perpendicular to each of the inside and outside surfaces of the sidewall.

According to a thirty-fifth aspect, the container may include the container of the first through twenty-ninth aspects or any other aspect, wherein the container further includes one or more chimes extending from the substantially rectangular bottom surface.

According to a thirty-sixth aspect, the container may include a sidewall extending upwardly from a bottom, the sidewall defining an interior of the container and terminating in a gasketless pail bead with a substantially rectangular cross-sectional portion for sealing the opening with a lid without use of a gasket, wherein: A) an inside surface of the sidewall terminates at a first corner of the gasketless pail bead; B) an outside surface of the sidewall forms a hook rim including a hook rim protrusion protruding outwardly from the outside surface of the sidewall; C) the outside surface of the sidewall terminates at a second corner of the gasketless pail bead; and D) the first and the second corner are connected by a portion of the sidewall that extends perpendicular to each of the inside and outside surfaces of the sidewall; a tamper evident satellite ring extending outwardly from the sidewall and below the gasketless pail bead, and a nesting satellite ring extending outwardly from the sidewall and the tamper evident satellite ring, wherein portions of the sidewall between the gasketless pail bead and the nesting satellite ring are corrugated.

According to a thirty-seventh aspect, the container may include the container of the thirty-sixth aspect or any other aspect, wherein the bottom is substantially circular.

According to a thirty-eighth aspect, the container lid may include the container lid of the thirty-sixth aspect or any other aspect, wherein the bottom is substantially rectangular.

According to a thirty-ninth aspect, the container lid may include the container lid of the thirty-eighth aspect or any other aspect, wherein: the sidewall extends upwardly from the substantially rectangular bottom; and a groove at each corner of the substantially rectangular bottom extends upwardly along corners of the sidewall and terminates between the gasketless pail bead and the tamper evident satellite ring, thereby creating a ledge within the interior of the container.

These and other aspects, features, and benefits of the claimed embodiment(s) will become apparent from the following detailed written description of the embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1A:
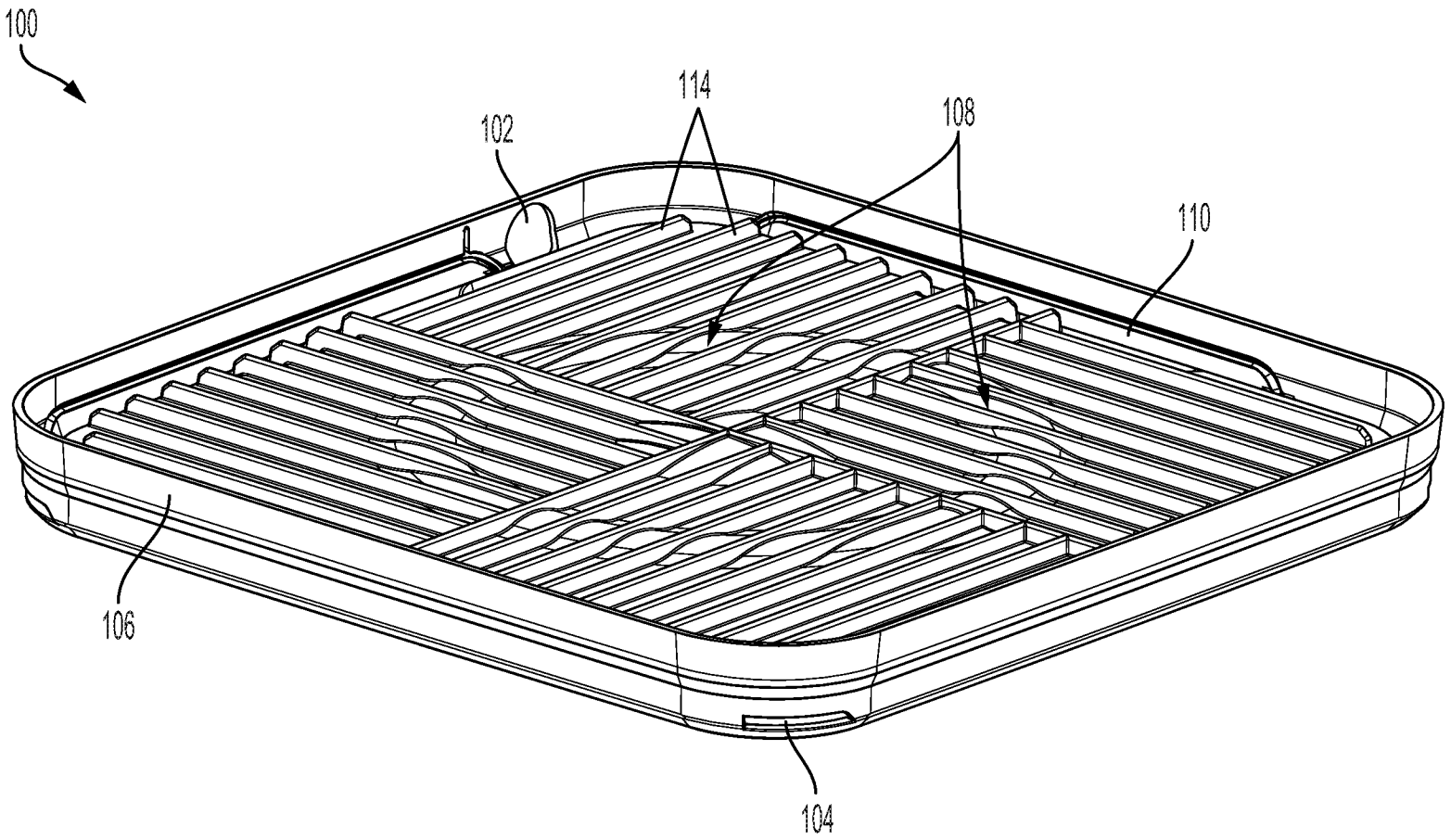
FIGS. 1A, 1B, 1C, and 1D are perspective bottom views of an exemplary square-shaped container lid, according to one embodiment of the present disclosure.
Figure 1B:
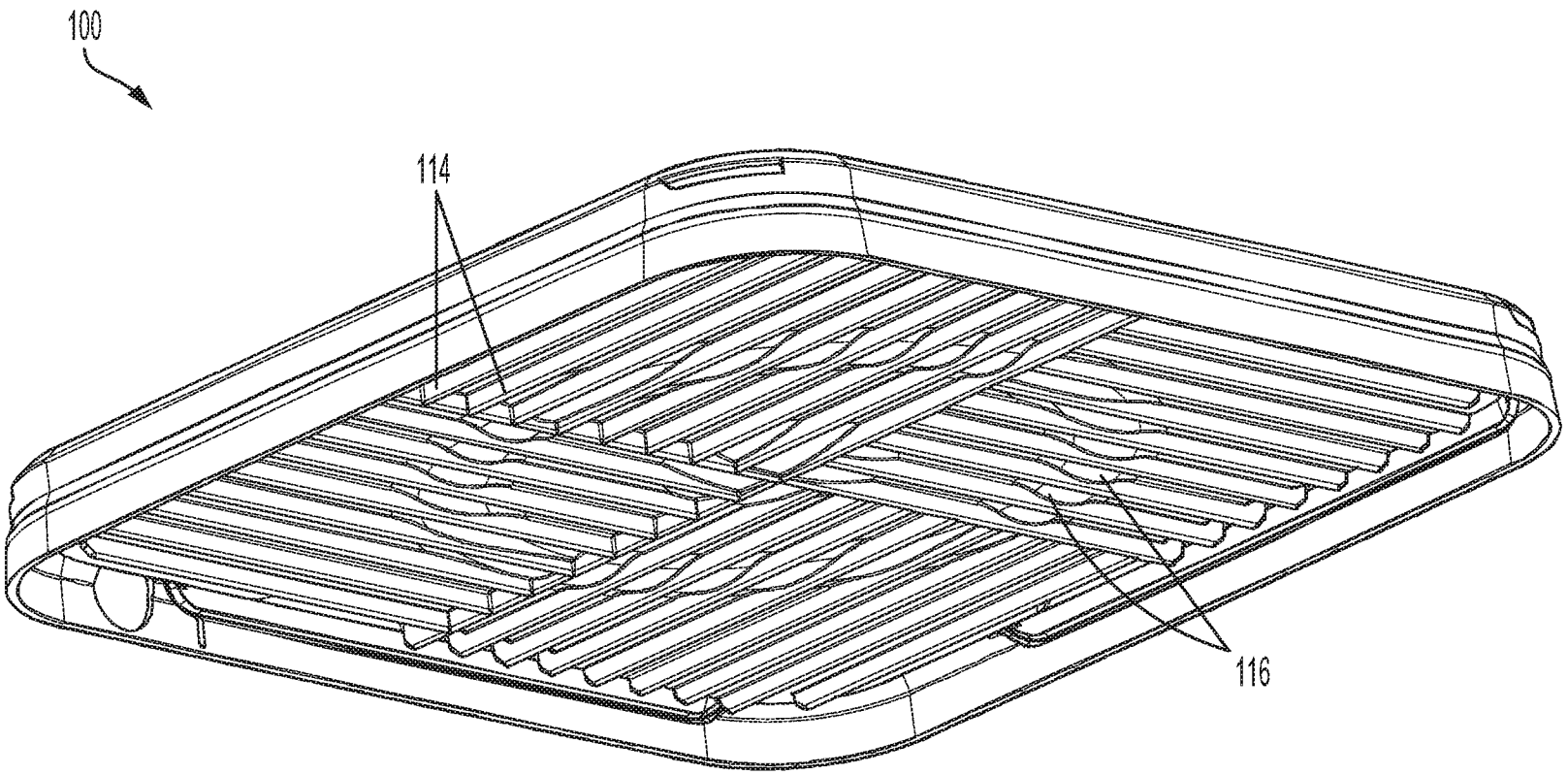

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with, and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Overview

The above and further features of the disclosed exemplary container and container lid will be recognized from the following detailed descriptions and drawings of particular embodiments. In various embodiments, a container with at least partially corrugated walls is disclosed. In particular embodiments, the container includes a large billboard that forms the outer casing of the container. In some embodiments, the container includes a gasket-less container bead around the rim of the container for increased sealant properties without using a gasket. According to at least one embodiment, the container includes a corner groove to improve strength and stability when stacking containers. In particular embodiments, the container includes one or more corner ledges to provide load support. To provide additional load support, in various embodiments, the container may include corner ribs. In one embodiment, the container includes bail ear assemblies to provide a mechanism for attaching a handle to the container. In certain embodiments, the container may include one or more satellite rings to facilitate tamper prevention and/or container nesting. According to at least one embodiment, the container is circular in shape. In at least one embodiment, the container is square in shape.

Furthermore, in various embodiments, a container lid with a built-in brine disc panel is disclosed. In particular embodiments, the built-in brine disc panel includes quadrants of alternating ridges that protrude from the bottom of the container lid. In some embodiments, the container lid includes a gasket-less seal feature for increased sealant properties without using a gasket. In particular embodiments, the container lid includes a corner window for a corner undercut, to further facilitate sealing. In some embodiments, the container lid includes a cover panel groove for cover rigidity. In certain embodiments, the container lid includes container stack lead-in features to facilitate container stacking. In one embodiment, the container lid includes a tamper evident tear strip located along the bottom portion of an outer rim of the container lid, which provides an indication when a container lid has been initially removed and is no longer originally sealed. In particular embodiments, the tamper evident tear strip may be removed by a ring-pull. In one or more embodiments, the container includes at least one or more lift tabs to facilitate removing the container lid. According to at least one embodiment, the container lid is circular in shape. In at least one embodiment, the container lid is square in shape. In one or more embodiments, the container lid may be manufactured to fit any container shape (e.g., rectangular, ovoid, etc.).

The container and container lid discussed herein may be formed in any suitable way. In various embodiments, the container and container lid are formed by injection molding. In particular embodiments, the container and container lid are 3D printed or created via other additive manufacturing technique. In further embodiments, various components of the container and container lid are formed or created separately, and the various components of the container and container lid are joined or otherwise suitably connected to form the container and container lid. In one embodiment, the container and container lid may each be one piece and unitary.

As will be understood by one of ordinary skill in the art, the container and container lid discussed herein may be used for storing and sealing any variety of materials, including, but not limited to: food (including pickles), paints, oils, consumer goods, construction materials, inks, chemicals, lubricants, adhesives, coatings, roofing mastics, driveway sealers, flavorings, sanitation supplies, building products, ice melt compounds, powders, pet food, and other such materials. The container and container lid may be formed from any suitable material or materials for storing or transporting such materials. In various embodiments, the container and container lid are manufactured from plastic (e.g., polyethylene, high-density polyethylene, etc.). In particular embodiments, the container and container lid are manufactured from a metal or composite material.

Exemplary Embodiments

Square Lid with Brine Disc

Turning now to FIGS. 1A, 1B, 1C, and 1D, perspective bottom views of an exemplary square-shaped container lid 100 are shown, according to one embodiment of the present disclosure. In particular embodiments, the exemplary square-shaped container lid 100 is configured to be securely positioned on top of a container, such as a pickle container, a general bucket for transporting materials, or any other appropriate container to provide a leak-resistant seal when securely positioned on top of the container. In some embodiments, the container lid is configured to push and submerge solids below the surface of liquids contained within the container.

According to various aspects of the present disclosure, and as shown in FIG. 1A, the square-shaped container lid 100 includes a brine disc panel 108 for at least partially submerging solids below the surface of liquids contained within a container. In one embodiment, the brine disc panel 108 includes alternating hatched patterns of downward protrusions (e.g., protruding ridges 114) to prevent the lid from "chipping" or "bowing", wherein each pattern occupies an equal amount of the square-shaped container lid's 100 area (e.g., a region). In some embodiments, the alternating hatched patterns of the brine disc panel 108 occupy unequal amounts of the square-shaped container lid's 100 surface area. In various embodiments, the downward protruding ridges 114 of the brine disc panel 108 can be flat and trapezoidal in shape such that they rest evenly on the container stack lead-ins 202 when multiple container lids 100 are in a stacked configuration. In certain embodiments, the downward protruding ridges 114 can be rounded, triangular, or any other suitable shape such that chipping or bowing can be prevented, and the brine disc panel can rest on container stack lead-ins 202 when in a stacked configuration.

For example, a user may fill a container with pickles and pickling brine, such that the pickles are rising to the top of, and breaking the surface level of, the brine. Continuing with this example, the user can secure said container with a square-shaped container lid 100 containing a built-in brine disc panel 108, and the protrusions (e.g., protruding ridges 114) of the brine disc panel will push and hold the pickles under the brine, while the brine is allowed to flow into the crevices of the brine disc panel 108 and engulf the pickles.

Continuing with FIG. 1A, in various aspects of the present disclosure, the square-shaped container lid 100 includes a lift tab 110 located on each of the inner side rails of the square-shaped container lid 100, at least partially for providing a leak-resistant seal. In one embodiment, when in a secured position on a container, the lift tabs 110 occupy a portion of the area along the corners of a container, but not the entire corner. Occupying a portion of the corners provides a tighter seal when the square-shaped container lid 100 is in a secured position on the container, without making the square-shaped container lid overly burdensome to open.

In some embodiments of the present disclosure, the lift tabs 110 are only located on two opposite inner side rails of the square-shaped container lid 100. Furthermore, in various embodiments of the present disclosure, the lift tabs are at least partially connected to a tamper evident tear strip 106 located around the outermost circumference of the square-shaped container lid 100.

According to one embodiment, the square-shaped container lid 100 includes a corner window 104 located at each corner (or at least one corner), that is used for a cover undercut that allows a container lid 100 to latch on to a container and form a secure seal.

In the embodiment shown in FIG. 1A, a ring pull 102 is located at an end of the tamper evident tear strip. As will be understood from discussions herein, a user desiring to remove a square-shaped container lid 100 secured to a container, first breaks the ring pull 102 to remove the tear strip 106 and reveal the lift tabs 110. The user can then remove the square-shaped container lid 100 by pulling outward and upward on the lift tabs 110.

Figure 1C:
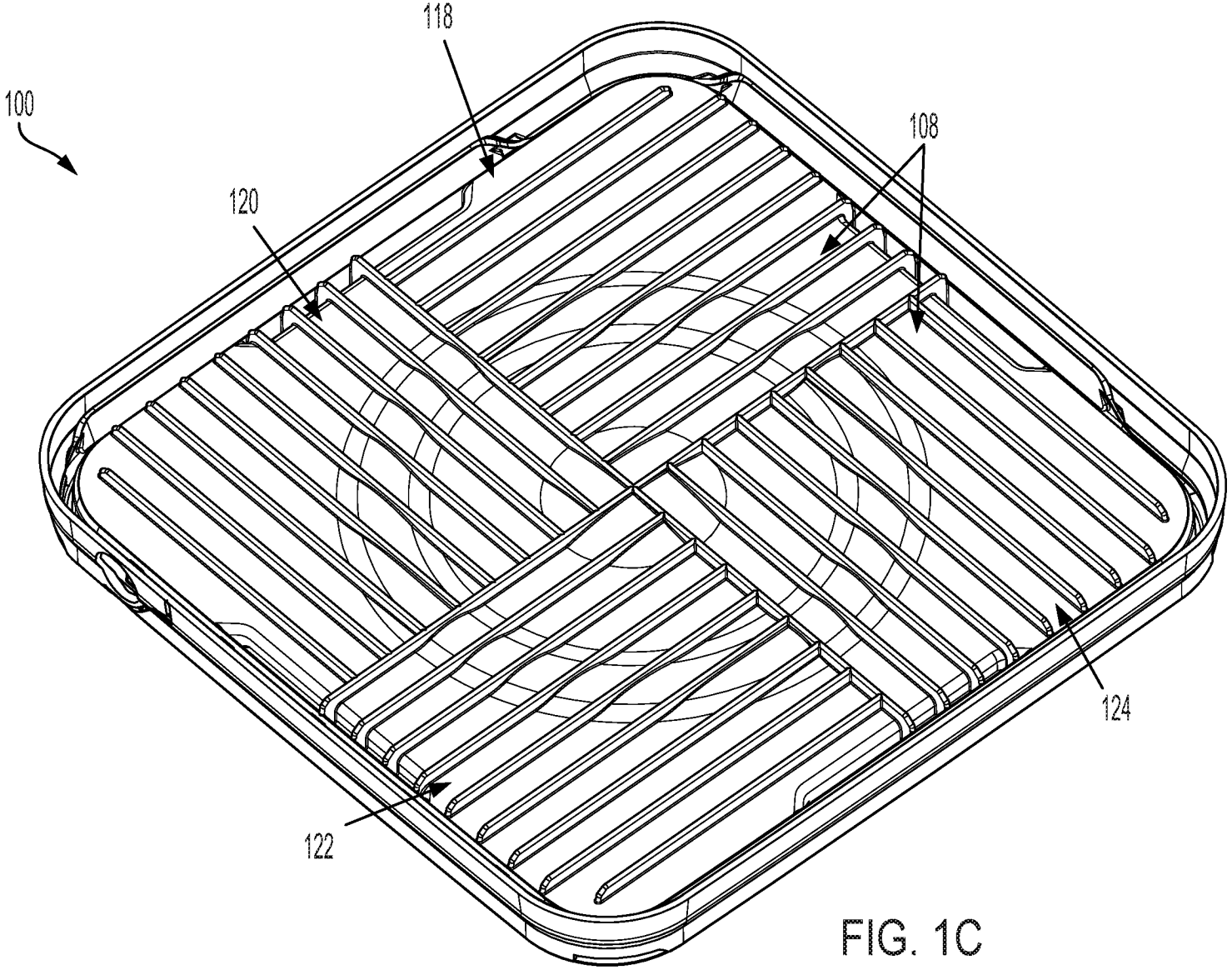
Figure 1D:
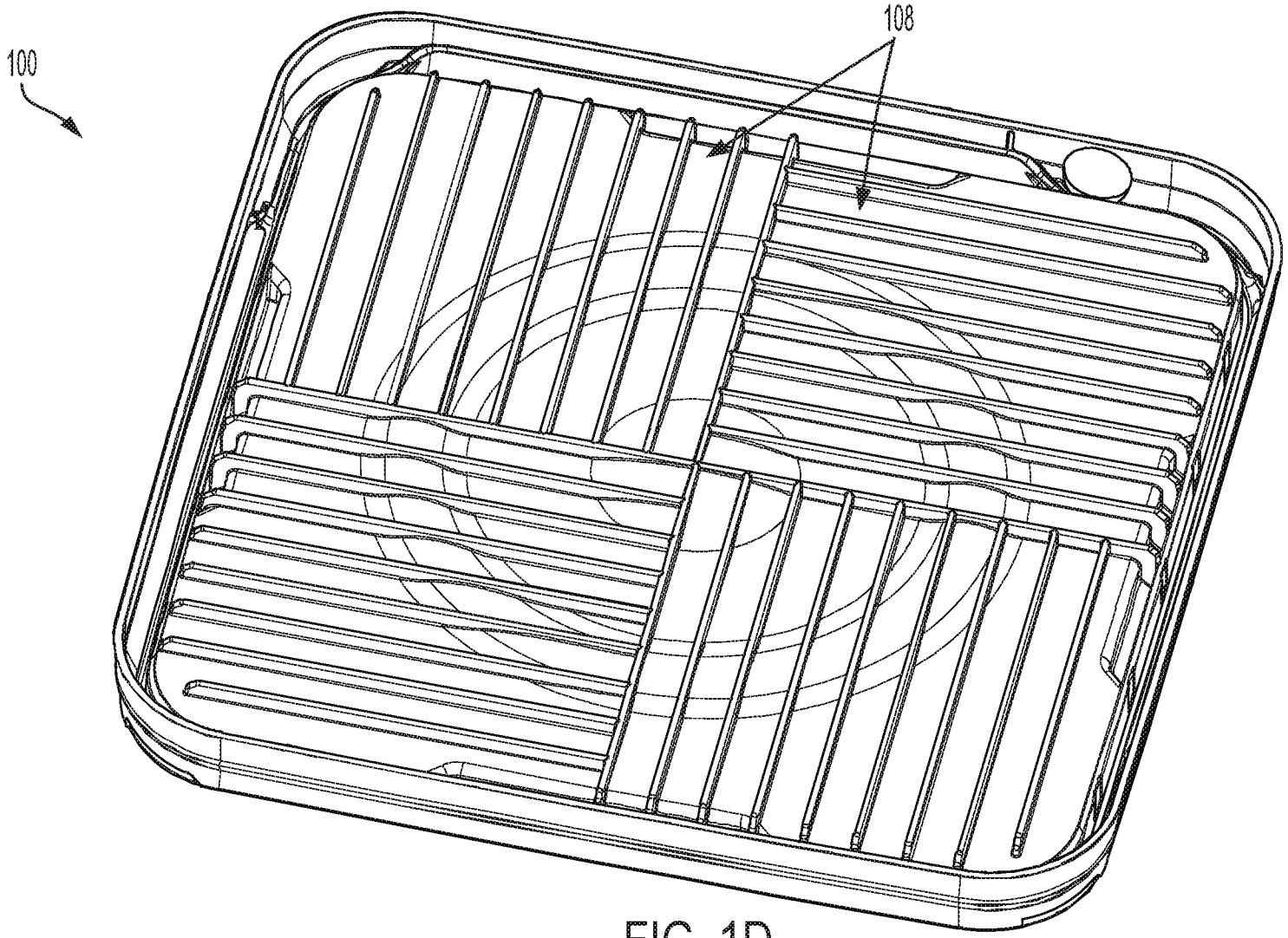

As will be further discussed herein, in various embodiments, the square-shaped container lid 100 may include a cover panel groove (e.g., cover panel groove 204 discussed in relation to FIG. 5) located in the center of a top surface of the square-shaped container lid 100. In the embodiment shown in FIG. 1B, a bottom surface of the cover panel groove 116 can be seen between the downward protruding ridges 114. As will be understood from discussions herein, in at least one embodiment, the bottom surface of the cover panel groove 116 may extend downwardly to a depth that is less than a depth of the downward protruding ridges 114. In further embodiments the bottom surface of the cover panel groove 116 may extend to a depth that is more than a depth of the downward protruding ridges 114 (or more than a depth of a portion of the protruding ridges 114). In still further embodiments, the square-shaped container lid 100 may include a brine disk (e.g., with downward protruding ridges 114), but may not include a cover panel groove 116. FIGS. 1C and 1D show perspective views of the square-shaped container lid 100, according to some embodiments. In the embodiment shown in FIG. 1C, the brine disc panel 108 includes four regions 118, 120, 122, and 124. In certain embodiments, the alternating hatched patterns of the brine disc panel 108 are organized into quadrants. In some embodiments, the alternating hatched patterns of the brine panel 108 are organized into sextants, octants, or any other suitable division of space.

Figure 2:
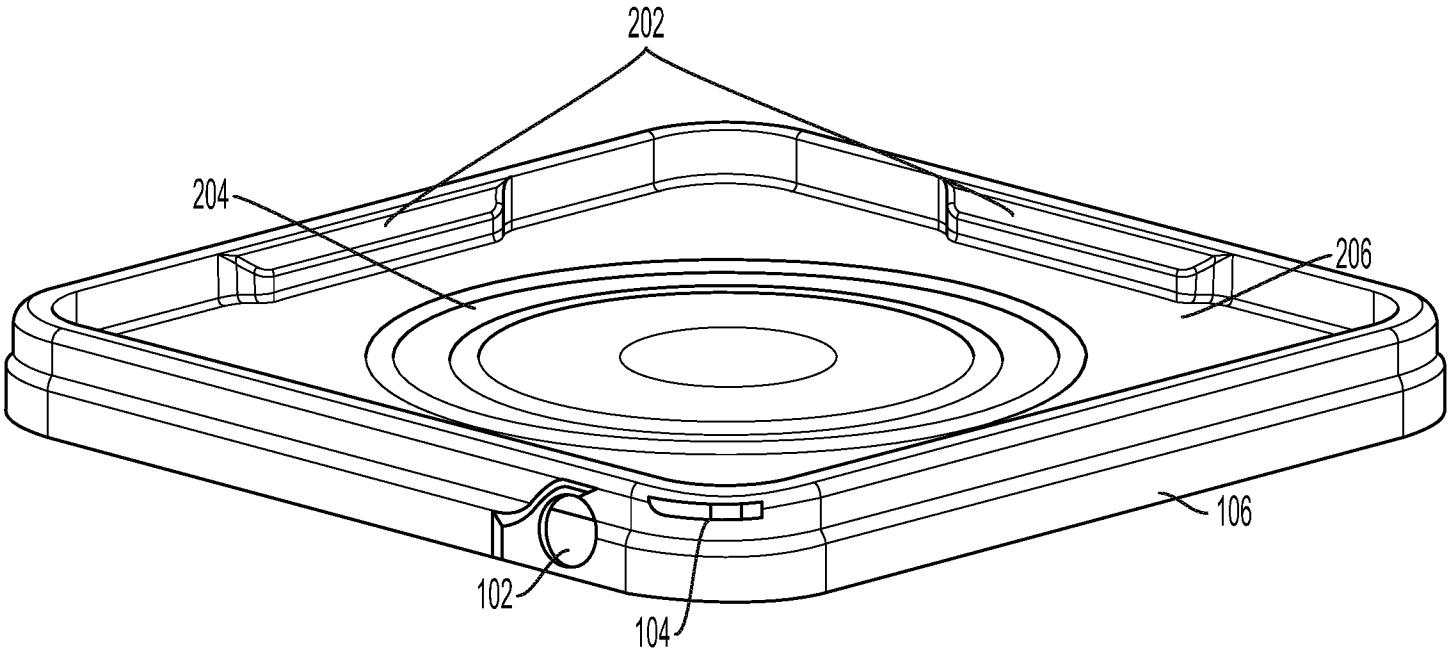
FIG. 2 is a perspective top view of an exemplary square-shaped container lid, according to one embodiment of the present disclosure.

Turning now to FIG. 2, a top view of an exemplary square-shaped container lid 100 is shown, according to one embodiment of the present disclosure. In at least one embodiment, container stack lead-ins 202 are located on each of the outer side rails of the square-shaped container lid 100. In various embodiments, and as will be further described herein, the container stack lead-ins 202 are protruding rectangular features that provide support when stacking containers (as shown in FIG. 5G) by accepting the bottom base of a container, and providing an enclosure on all four sides. In some embodiments, the container stack lead-ins 202 can accept, and provide an enclosure on, less than all four sides of the bottom base of a container. In particular embodiments, the container stack lead-ins 202 can be trapezoidal in shape, or can resemble any other suitable polygon. Additionally, in some embodiments, the container stack lead-ins 202 can be as long as (or shorter than) the length of the container lid 100.

In some embodiments, a cover panel groove 204 is located in the center of a cover panel 206 of the square-shaped container lid 100. In various embodiments, and as will be further described in relation to FIG. 5A herein, a cover panel groove 204 can provide a flat surface and rigidity for accepting the bottom portion of an additional container when in a stacked configuration (as shown in FIG. 5G).

Figure 3A:
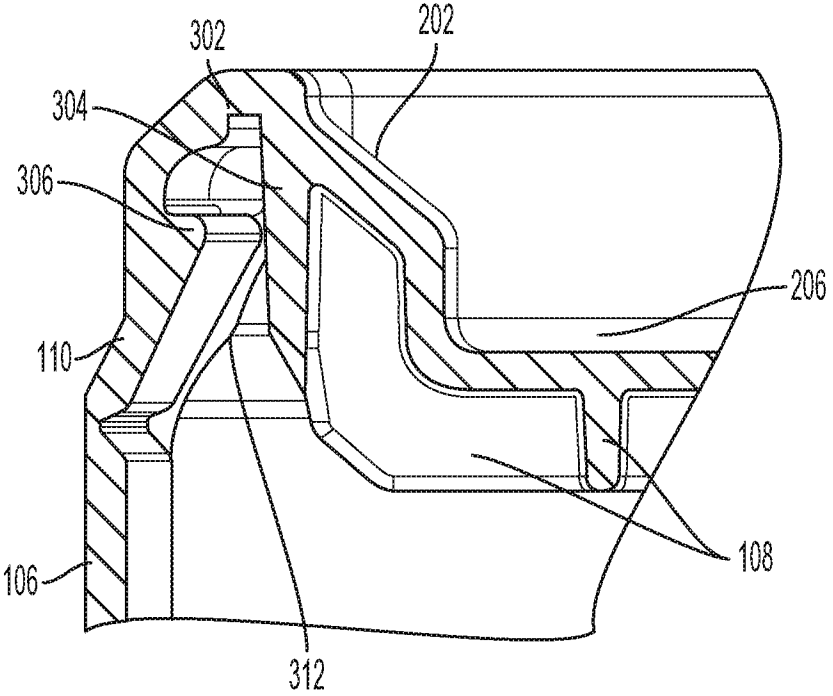
FIGS. 3A, 3B, and 3C are cross sectional views of an exemplary square-shaped container lid, according to one embodiment of the present disclosure.
Figure 3B:
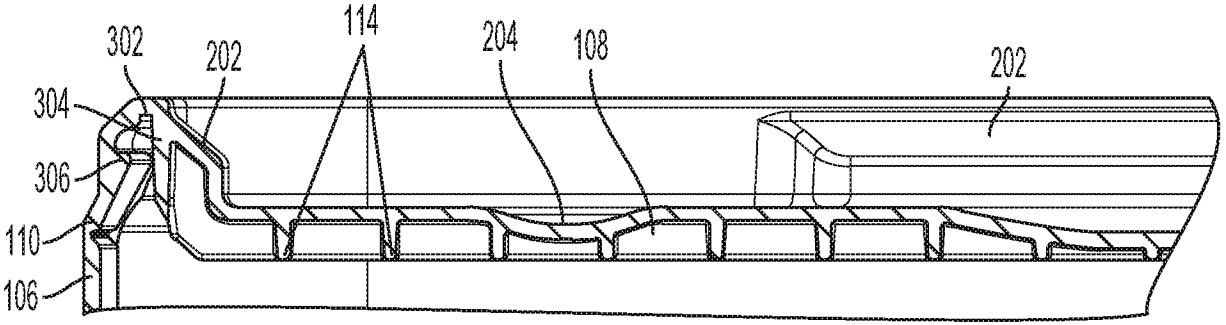
Figure 3C:
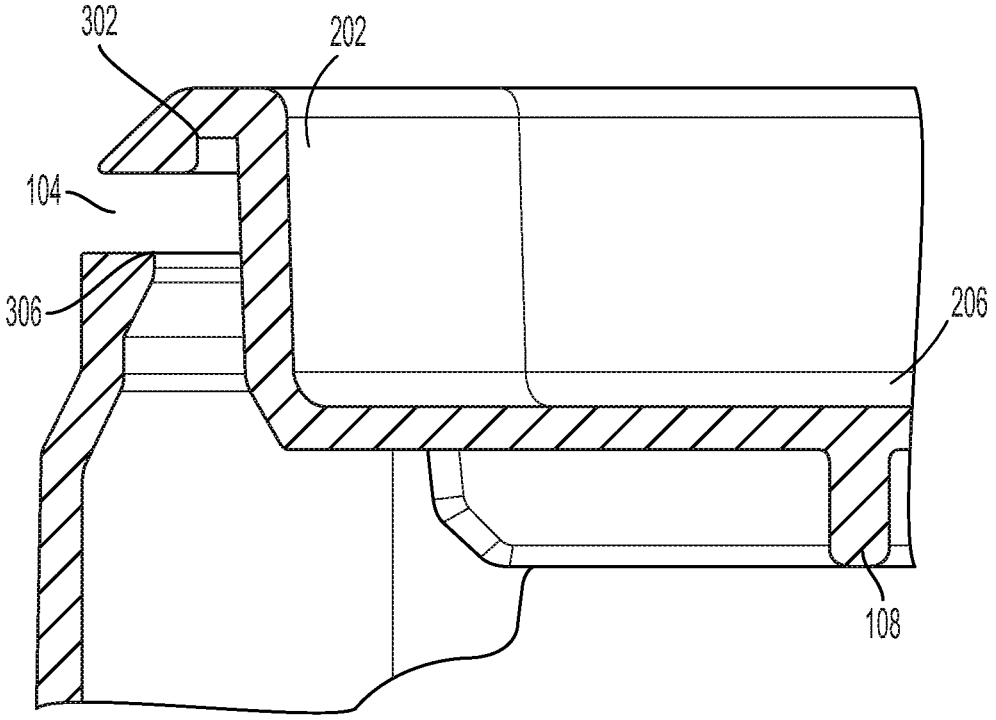

Referring now to FIGS. 3A, 3B, and 3C, cross sections of an exemplary square-shaped container lid 100 are shown, according to one aspect of the present disclosure. In the present embodiment, and as shown in FIGS. 3A, 3B, and 3C, a container stack lead-in 202 is shown extending downwards from a cover inner skirt 304 at an angle towards a cover panel 206. In certain embodiments, the container stack lead-in 202 can be substantially perpendicular to the cover inner skirt 304 and substantially parallel to the cover panel 206. In particular embodiments, the cover inner skirt 304 forms one side wall of a seal portion 312. In one embodiment, the seal portion 312 is flanked by the cover inner skirt 304 forming one side wall, a cover undercut 306 forming an opposite side wall, and a rectangular gasket-less seal feature 302 connecting the two side walls (e.g., side walls 304 and 306) at the top of the square-shaped container lid 100, and forming an enclosure. In particular embodiments, the gasket-less seal feature 302 works in tandem with a corresponding gasket-less container bead 422 on a container (as further discussed herein) to form a liquid-tight seal without the need for a gasket.

In one embodiment, and as shown in FIG. 3B, there is a substantially constant distance between the ridges 114 of the brine disc panel 108. In some embodiments, this configuration helps prevent the cover from chipping and bowing over time, which can be an issue with lids that do not have a cross-hatched protrusion pattern. In at least one embodiment, the distance between ridges 114 can fluctuate as well as the alternating pattern of the brine disc panel 108 in order to achieve optimal stability of the square-shaped container lid 100. In particular embodiments, the ridges 114 of the brine disc panel 108 may be parallel to each other. In various embodiments, the ridges 114 may be rectangular, trapezoidal, or any other suitable shape.

Figure 3D:
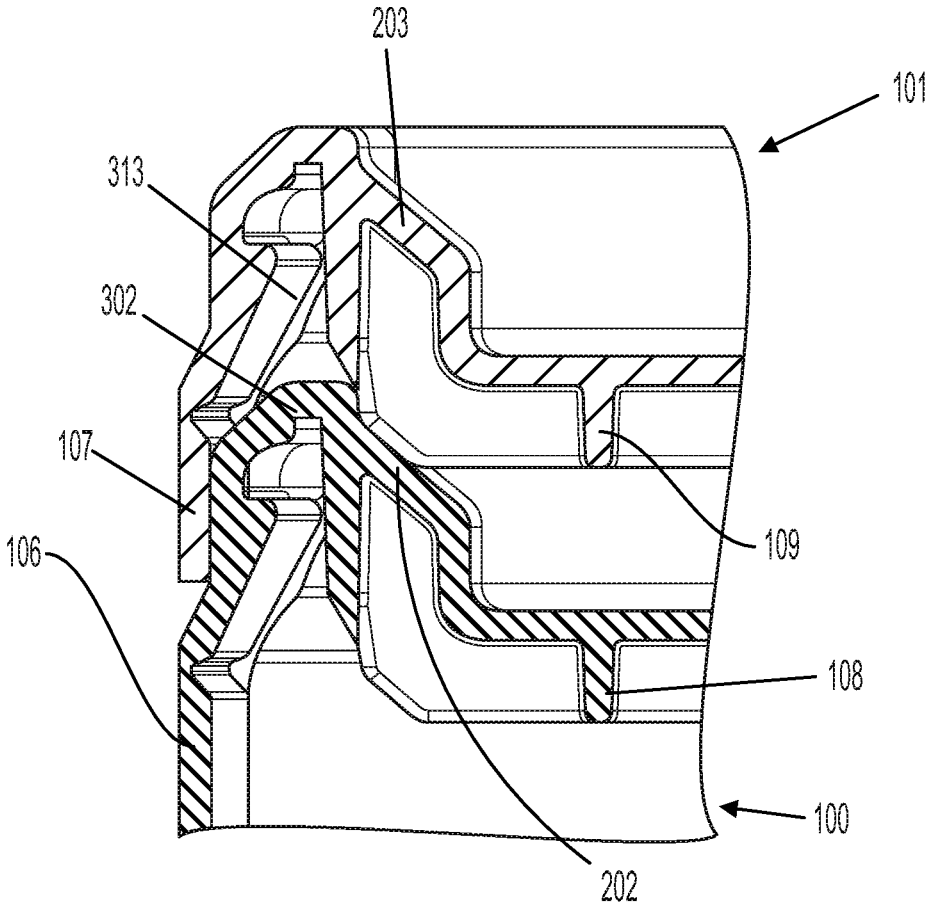
FIG. 3D is a cross-sectional view of two exemplary square-shaped container lids in a stacked orientation, according to one embodiment of the present disclosure.

FIG. 3D shows a cross sectional view of exemplary square-shaped container lids 100 and 101 in a stacked orientation, according to one embodiment of the present disclosure. In a particular embodiment, the container stack lead-in 202 of the bottom square-shaped container lid 100 shown in FIG. 3D serves as a base for the top square-shaped container lid 101 to rest securely on top of. As discussed above, the brine disc panels 108 and 109 can facilitate stacking when the protruding ridges are angled downward in the same direction as the container stack lead-ins 202 and 203. In various embodiments, the seal portion 313 of the top square-shaped container lid 101 operates to accept the top edge of the bottom square-shaped container lid 100, which includes the gasket-less seal feature 302. In a particular embodiment, in a stacked orientation, the distance between the bottom of the tear strip 107 on the top square-shaped container lid 101, and the bottom of the tear strip 106 on the bottom square-shaped container lid 100 is may be at least approximately one-quarter of an inch.

Square Container

Figure 4A:
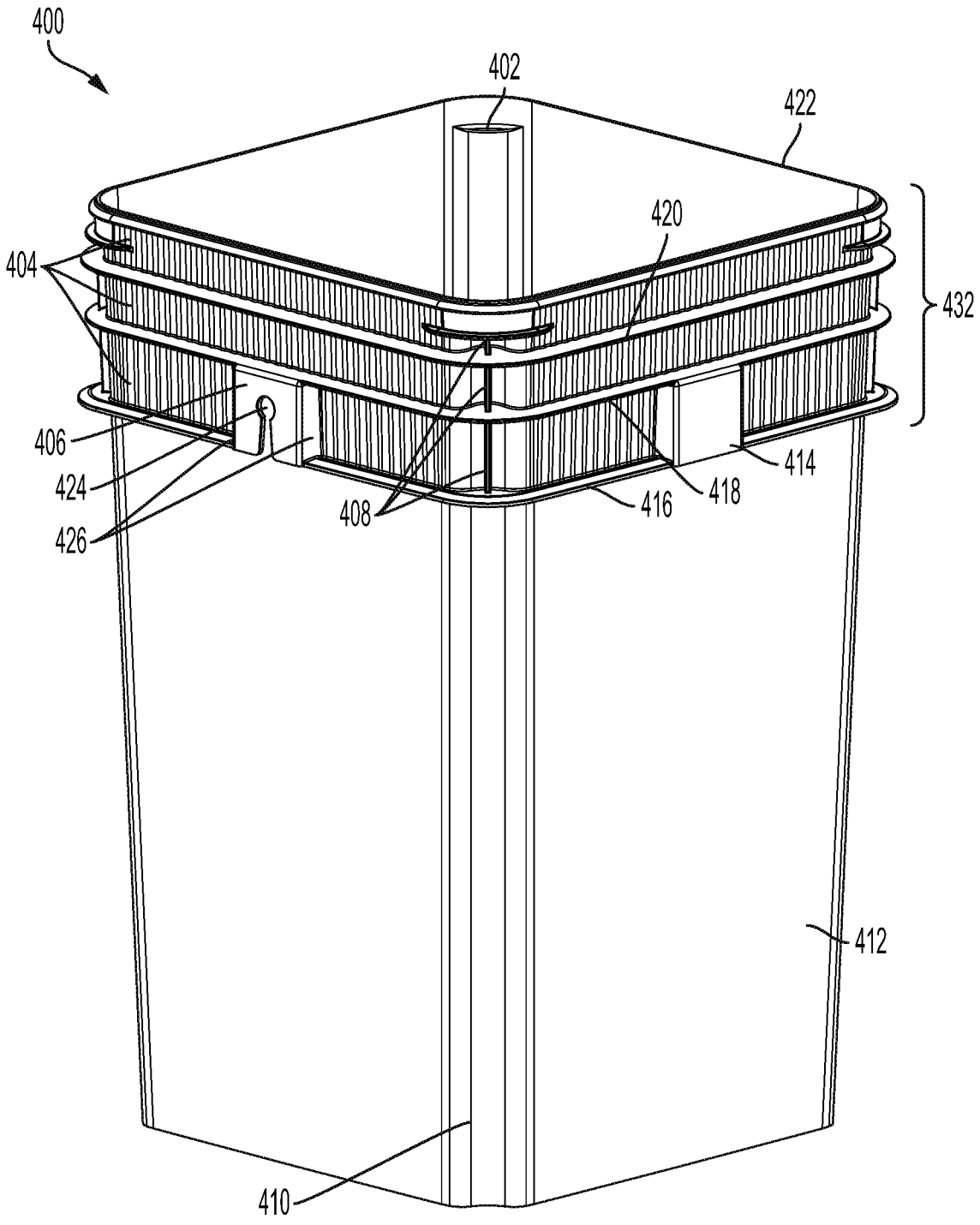
FIG. 4A is a perspective view of an exemplary square-shaped container, according to one embodiment of the present disclosure.

Turning now to FIG. 4A, a perspective view of an exemplary square-shaped container 400 is shown, according to one embodiment of the present disclosure. In a particular embodiment, the exemplary square-shaped container includes a large billboard (e.g., sidewall) 412 on all four sides to enclose the square-shaped container 400 and provide a solid base for stability. In the embodiment shown in FIG. 4A, the square-shaped container 400 includes a corner groove 410 on all four corners to provide additional strength and support when square-shaped containers 400 are in a stacked configuration. In some embodiments, the corner groove 410 can be on less than all four corners (e.g., on two corners).

In particular embodiments, the square-shaped container 400 includes corrugated side wall portions 404 for additional stability, and a bumper assembly 432 (including one or more satellite rings 416, 418, and/or 420) around the upper portion of the square-shaped container 400. In various embodiments, the square-shaped container 400 includes corner ribs 408 on the outside surface of one or more corners for additional load support, and bail ears 406 and 414, either blank 414 or active 406, as will be further discussed herein.

On the inside of the container 400, opposite from the corner ribs 408, particular embodiments include corner ledges 402 on one or more corners of the square-shaped container 400 to assist in providing load support. In one or more embodiments, the corner ribs 408 provide support for the corner ledges 402. According to at least one embodiment, corner ledges 402 are trapezoidal in shape. In particular embodiments, corner ledges 402 can be triangular, circular, or of any suitable shape. In various embodiments, the distance from the top of the container to the corner ledge may be greater than one-half of an inch.

In various embodiments, and as further discussed herein, the rim of the square-shaped container 400 includes a rectangular-shaped gasket-less container bead feature 422 to provide a gasket-less seal when a square-shaped container lid 100 is attached.

Continuing with FIG. 4A, in particular embodiments, a square-shaped container 400 may include a bumper assembly 432 for, among other things, protect the square-shaped container 400 when it comes into contact with other objects. In various embodiments, the bumper assembly 432 may include one or more satellite rings 418. In one embodiment, the bumper assembly 432 includes three satellite rings: a general satellite ring 418, a nesting satellite ring 416, and a tamper evident satellite ring 420. In one or more embodiments, the nesting satellite ring 416 protrudes outwardly from the billboard 412 slightly further than both the general satellite ring 418 and the tamper evident satellite ring 420. Traditional containers tend to experience problems when two or more containers are placed next to each other due to configurations that can cause components to conflict. In certain embodiments, the nesting satellite ring 416 within the bumper assembly 432, allows more square-shaped containers 400 to fit into a smaller space because they can be placed closer together without disrupting usage (e.g., with less conflict). This feature may allow more containers to fit on a pallet or otherwise to be shipped at the same time.

Continuing with the embodiment shown in FIG. 4A, the square-shaped container 400 includes a tamper evident satellite ring 420 around its perimeter that works in tandem with the tamper evident tear strip 106 included on the square-shaped container lid 100. In the event the square-shaped container lid 100 is used to seal the square-shaped container 400, the tamper evident tear strip 106 is positioned about the tamper evident satellite ring 420 such that the tamper evident satellite ring serves as a barrier to prevent any attempts to remove the square-shaped container lid by reaching under the tamper evident tear strip.

Continuing with FIG. 4A, in particular embodiments, the square-shaped container 400 includes an active bail ear 406 and an additional active bail ear on an opposite side walls of the exterior of the square-shaped container 400 (additional active bail ear not shown in FIG. 4A). In the embodiment shown, the active bail ear 405 is centrally located between the general satellite ring 418 and the nesting satellite ring 416. In one or more embodiments, each active bail ear includes an opening 424 of varying sizes that allows for the attachment of a handle that can be used for carrying the square-shaped container 400. Each active bail ear, in particular embodiments, includes vertical support structures 426 for additional load bearing support when a handle is used to carry the square-shaped container 400.

In the embodiment shown in FIG. 4A, the square-shaped container 400 includes a blank bail ear 414 located on a side wall adjacent to the active bail ear 406 between the general satellite ring 418 and the nesting satellite ring 416. As will be understood from discussions herein, the container 400 may include a second blank bail ear located on a side wall opposite blank bail ear 404 (not shown).

Further continuing with FIG. 4A, in particular embodiments, corner ribs 408 are located at the exterior corners of the square-shaped container 400. In one or more embodiments, the corner ribs 408 are vertically positioned between the plurality of satellite rings 416, 418, and 420 and within the corner grooves 410 of the square-shaped container 400. This positioning of the corner ribs 408, in particular embodiments provides additional load support in stacking configurations when one square-shaped container 400 is placed within another square-shaped container 400 by facilitating load transfer from the ledge 402 to the nesting satellite ring 416.

In various embodiments, the square-shaped container 400 shown in FIG. 4A includes a gasket-less container bead 422 located around the rim of the square-shaped container 400. In some embodiments, in the event the square-shaped container lid 100 is used to seal the square-shaped container 400, a gasket-less container feature 302 included in the square-shaped container lid 100 (as shown in FIG. 3C) accepts the gasket-less container bead 422 located around the rim of the square-shaped container 400. In a particular embodiment, the gasket-less container bead 422 is generally square-shaped, such that when it is engaged with the gasket-less container feature 302, it forms a liquid-tight seal without the use of gaskets.

Figure 4C:
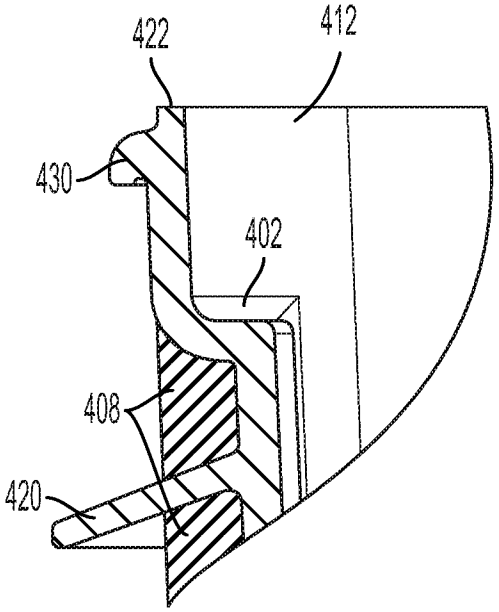
FIGS. 4B and 4C are cross-sectional views of an exemplary square-shaped container, according to one embodiment of the present disclosure.
Figure 4B:
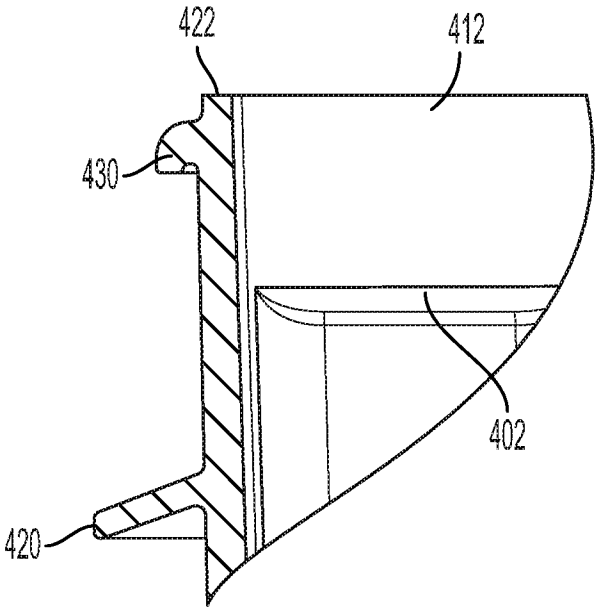

FIGS. 4B and 4C show cross-sectional views of the upper portion of the square-shaped container 400, according to one embodiment of the present disclosure. As shown in FIG. 4B, the corner ledge 402 is substantially perpendicular to the billboard 412 of the container, such that weight may be dispersed when in a stacking configuration. As shown in FIG. 4C, the corner ribs 408 may vertically extended through and below the tamper evident satellite ring 420 in order to provide additional load support to the corner ledge 402. Although in the embodiment shown, the ribs 408 extend the entire distance between the satellite ring 420 and the corner ledge 402, the length of the corner ribs 408 may vary in embodiments not shown in order to optimize load support. For example, in one embodiment, the corner ribs may extend the entire length of the container. In another embodiment, the corner ribs may extend between two or more satellite rings (e.g., three satellite rings, five satellite rings, etc.).

In some embodiments, the square-shaped container 400 includes a rim hook 430 that the lift tabs 110 (as shown in FIG. 1A) on a square-shaped container lid can latch onto to provide for a tight seal. In various embodiments, the rim hook 430 is located directly below the gasket-less container bead 422 around the outer rim of the square-shaped container 400. In some embodiments, the rim hook 430 extends outward and downward from the square-shaped container to form a hooking mechanism. In various embodiments, the rim hook 430 may include a substantially flat bottom portion and a curved upper portion.

Figure 4F:
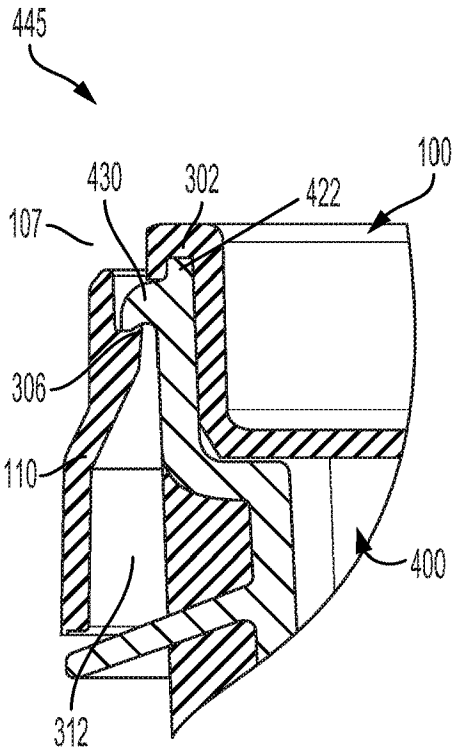
FIGS. 4D, 4E, and 4F are cross-sectional views of exemplary square-shaped containers sealed with exemplary square-shaped container lids, according to embodiments of the present disclosure.
Figure 4E:
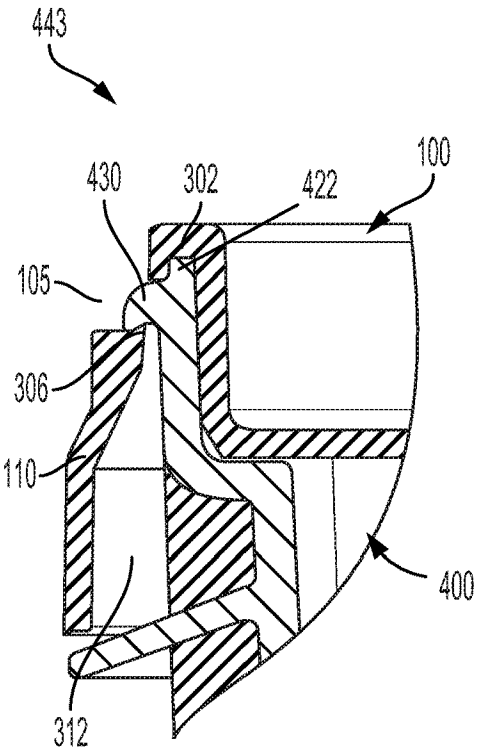
Figure 4D:
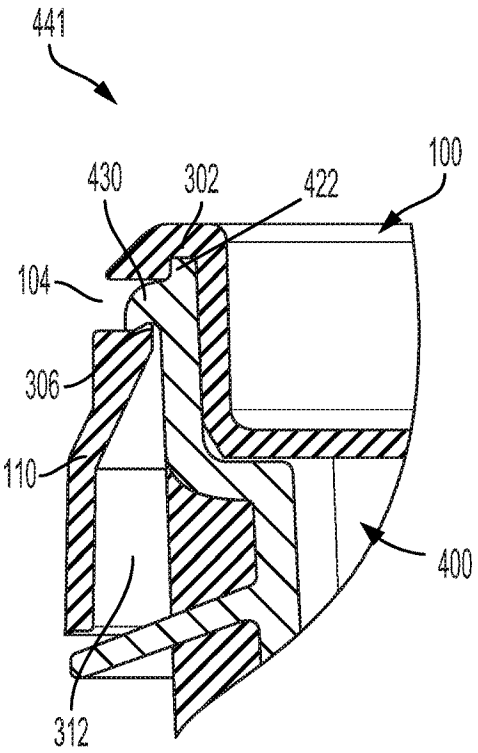

FIGS. 4D, 4E, and 4F illustrate cross-sectional views of three embodiments of exemplary square-shaped containers 400 sealed with exemplary square-shaped container lids 100, each lid with a different corner window. In the first embodiment 441, as shown in FIG. 4D, a corner window 104 is sufficiently open, such that a cover undercut 306 of the lid 100 engages a rim hook 430 of the container 400 from the bottom, and a gasket-less seal feature 302 extends out over the rim hook 430.

FIG. 4E shows a second embodiment 443, that illustrates a wider corner window 104, which expands the exposure of the rim hook 430 by reducing the extension of the gasket-less seal feature 302 over the rim hook 430. The third embodiment 445, as shown in FIG. 4F, illustrates a narrower corner window 104, as the sidewall connected to the cover undercut 306 protrudes upward and creates a semi-enclosure around the rim hook 430. Various embodiments of the present disclosure may further expand or decrease the size of the corner window 104, such that an optimal seal and lid release tension may be obtained.

In various embodiments, and as shown in FIGS. 4D, 4E, and 4F, the cover undercut 306 protrudes upward from the lift tabs 110 and into a seal portion 312. Continuing with these embodiments, in the event the square-shaped container lid 100 is used to seal a container, the rim of the container enters the seal portion 312 and forms a seal when the gasket-less seal feature 302 engages with the gasket-less container bead 422. In particular embodiment, the sloping shape of the cover undercut 306 facilitates affixing container lids to containers. Further continuing with this embodiment, once a seal is established, or before a seal is established, the cover undercut 306 locks into place around, or under, the rim hook 430 located around the perimeter of a container. As mentioned above, in order to remove the square-shaped container lid 100 once a seal is established, in various embodiments, a user pulls and removes the tear strip 106 from the perimeter of the square-shaped container lid 100 to reveal/expose the lift tabs 110. The user can then remove the square-shaped container lid 100 by pulling outward and upward on the lift tabs 110.

Figure 5B:
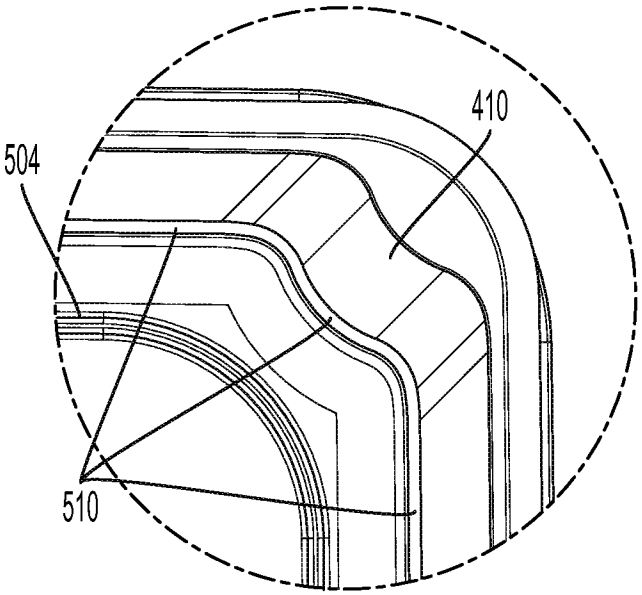
FIGS. 5A and 5B are top views of an exemplary square-shaped container, according to one embodiment of the present disclosure.
Figure 5A:
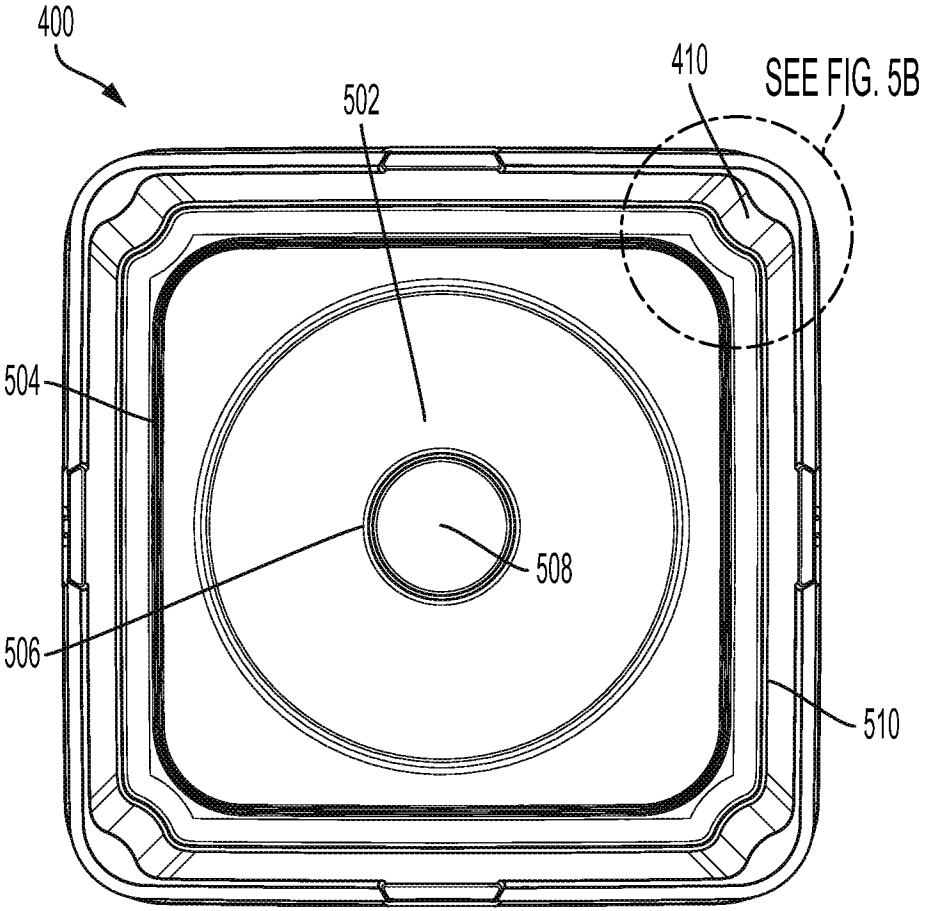

Turning now to FIGS. 5A and 5B, top views of an exemplary square-shaped container 400 are shown, according to one embodiment of the present disclosure. In various embodiments, the exemplary square-shaped container 400 includes container bottom chimes 504 and 510. In particular embodiments, the primary container bottom chime 510 and the secondary container bottom chime 504 work in tandem to provide a stable base for the container 400 when the container 400 is laid to rest on a surface. Additionally, in one or more embodiments, the primary bottom chime 510 and the secondary container bottom chime 504 assist in protecting the square-shaped container 400 such that it is not easily damaged when handled.

In one embodiment, the exemplary square-shaped container 400 includes a recessed container bottom 502 of circular shape, and a container bottom dimple 508, also of circular shape, to increase stability and facilitate the stacking of one or more square-shaped containers 400 secured with square-shaped container lids 100 (as shown in FIG. 5G). In one or more embodiments, a recessed container bottom 502 and a container bottom dimple 508 may be of any suitable size or shape. In particular embodiments, when square-shaped containers 400 sealed with square-shaped container lids 100 are in a stacked configuration, the recessed container bottom 502 and the container bottom dimple 508 fit into the cover panel groove 204 on the square-shaped container lid 100 to stabilize and provide better load support when stacking. In one or more embodiments, a square-shaped container 400 includes a container gate protector ring 506 around the circumference of the container bottom dimple 508 to further facilitate stability when sealed containers are in a stacked configuration.

In the embodiments shown in FIGS. 5A and 5B, and as discussed above in relation to FIG. 4A, the square-shaped container 400 includes one or more corner grooves 410 to provide additional strength and support when one or more square-shaped containers 400 are in a stacked configuration.

Figure 5D:
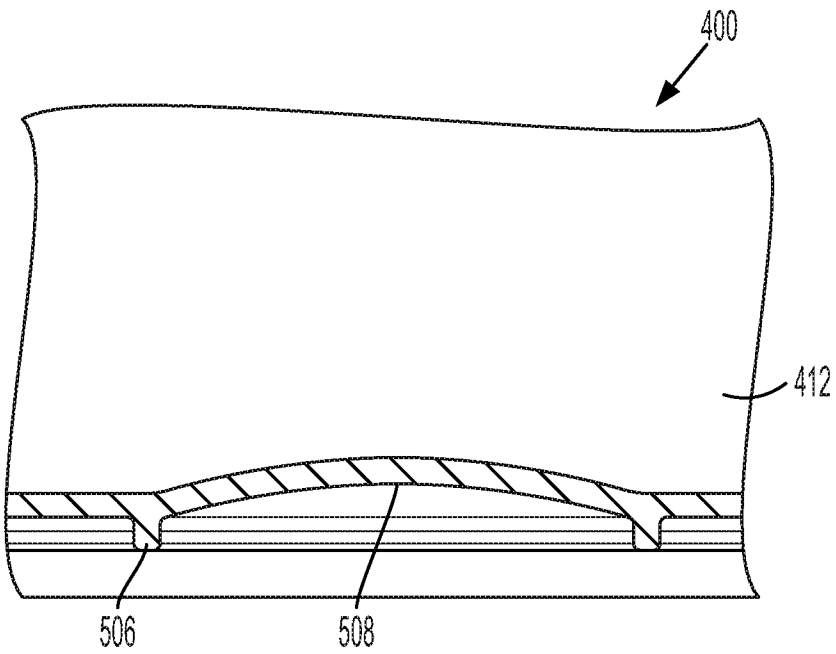
FIGS. 5C and 5D are cross sectional views of an exemplary square-shaped container, according to one embodiment of the present disclosure.
Figure 5C:
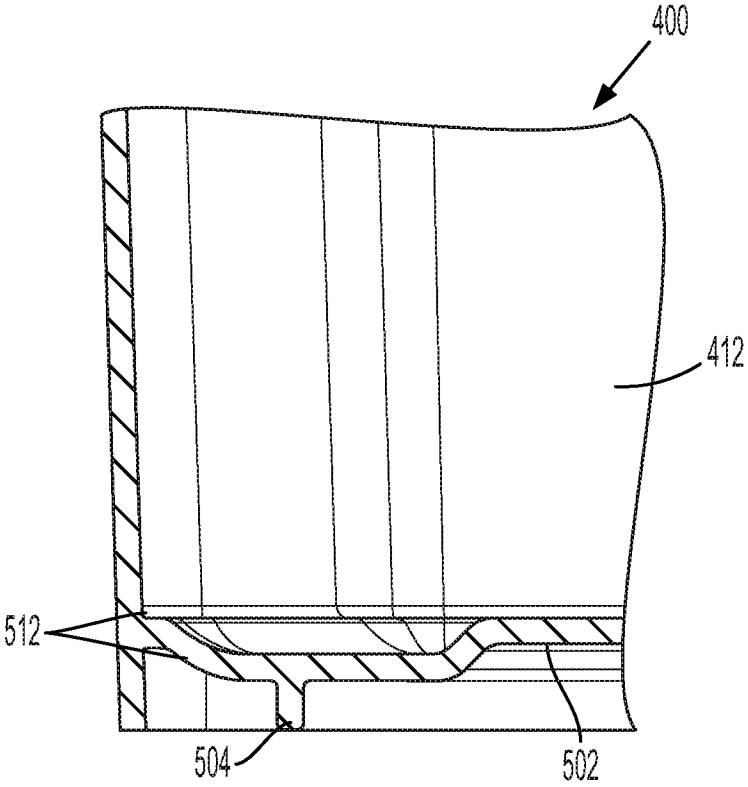

Turning now to FIGS. 5C and 5D, cross-sectional views of the bottom portion of a square-shaped container 400 are shown, according to one embodiment of the present disclosure. As shown in FIG. 5C, the square-shaped container 400 includes side contours 512, which are curvatures at juncture (s) where a bottom of the container connects to a billboard 412, and provide impact strength for the square-shaped container 400. In various embodiments, the square-shaped container 400 includes a secondary container bottom chime 504. The secondary container bottom chime 504, in at least one embodiment, is used to provide a flat base for the square-shaped container 400. Further, in one or more embodiments, the secondary container bottom chime 504 is configured to help stabilize the square-shaped container when in a stacked configuration.

In particular embodiments, the square shaped container includes a gate protector ring 506 located around the circumference of a container bottom dimple 508 to increase stability and help disperse weight throughout the bottom of the container. In one or more embodiments, and as shown in FIG. 5D, the container bottom dimple 508 may be curved inward to facilitate stacking on containers sealed with container lids.

Figure 5F:
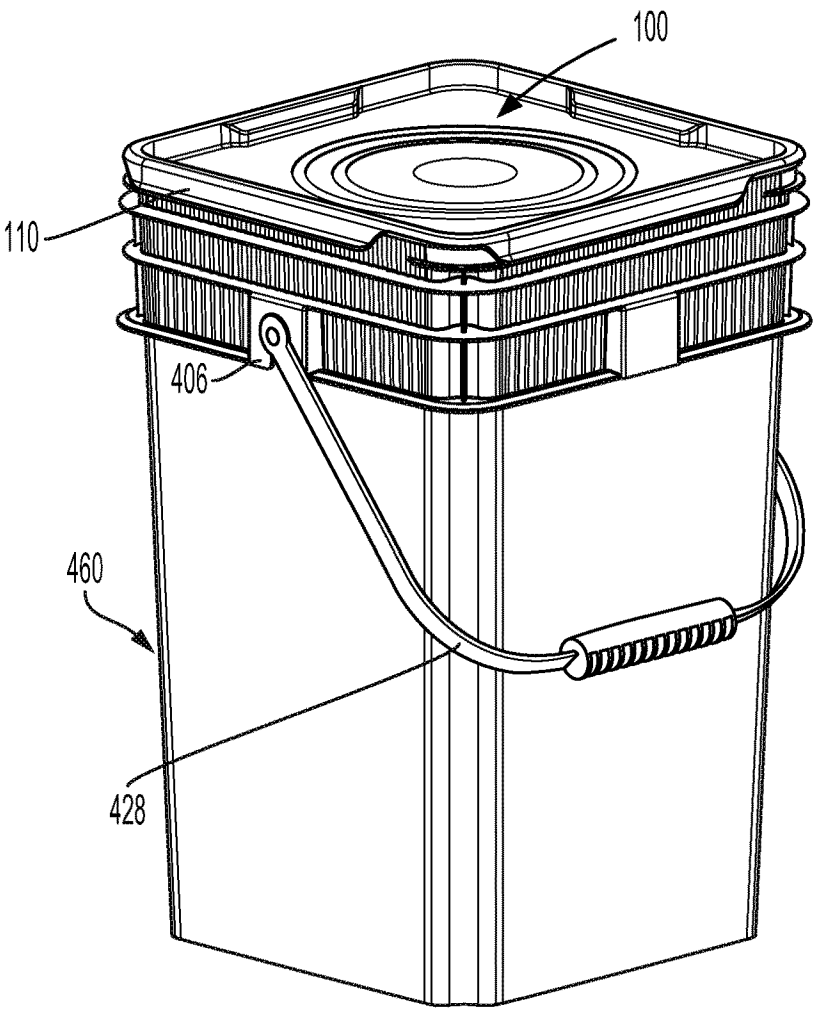
FIGS. 5E and 5F are perspective views of exemplary square-shaped containers and lids, according to one embodiment of the present disclosure.
Figure 5E:
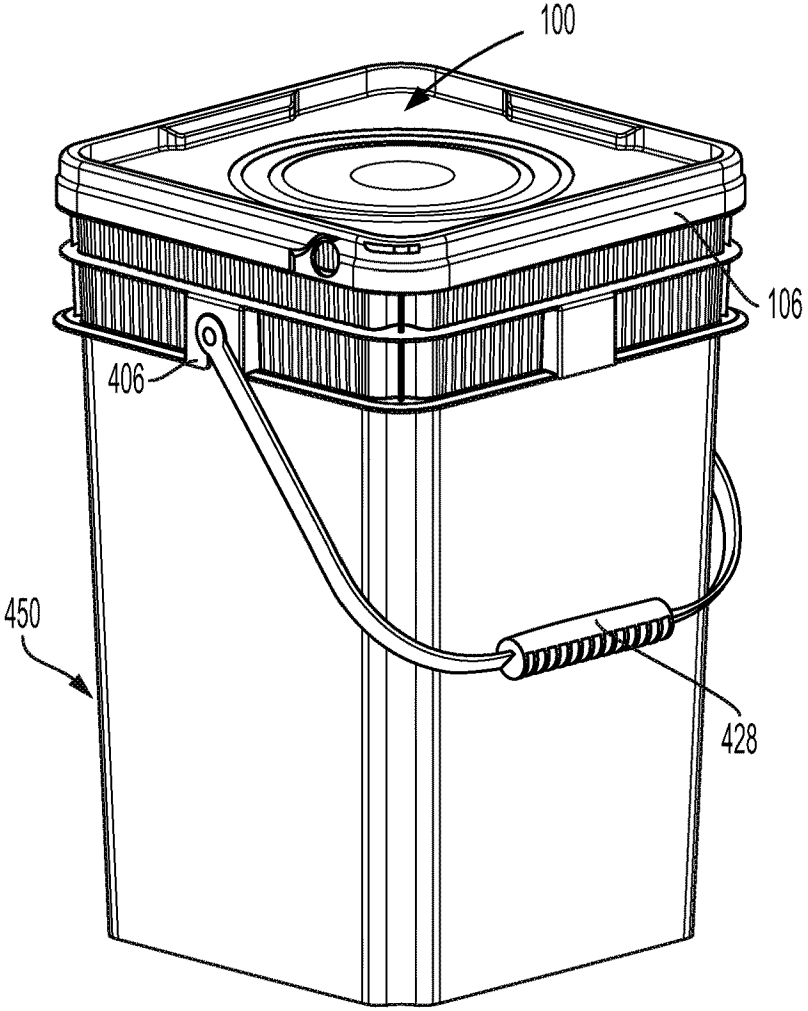
Figure 5G:
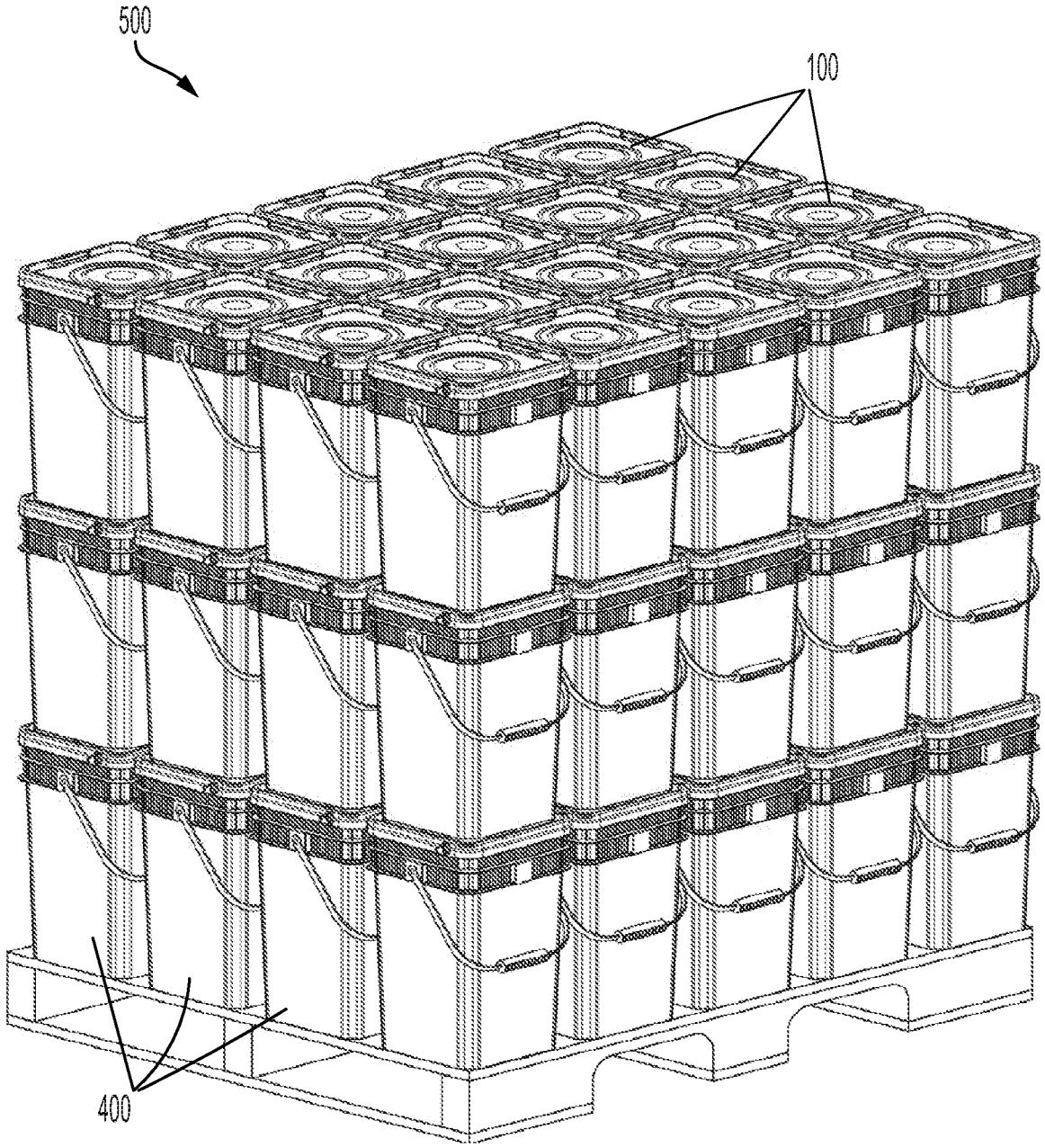
FIG. 5G is a perspective view of stacked exemplary square-shaped containers and lids, according to one embodiment of the present disclosure.

FIGS. 5E and 5F show square-shaped containers 450 and 460 sealed with square-shaped container lids, according to one embodiment of the present disclosure. FIG. 5E shows a square-shaped container 450 completely sealed with a square-shaped container lid 100, such that a tamper evident tear strip 106 is attached to lift tabs 110, indicating that the square-shaped container 450 has not been opened. Continuing with the embodiments shown in FIGS. 5E and 5F, FIG. 5F also includes a square-shaped container 460 sealed with a square-shaped container lid. In this embodiment, the square-shaped container lid 100 is shown with lift tabs 110, but does not include a tamper evident tear strip 106, which indicates the original seal has been broken (e.g., the tear strip 106 has been removed). Additionally, and as shown in FIGS. 5E and 5F and according to one embodiment of the present disclosure, a handle 428 is attached to bail ears (e.g., bail ear 406 and an opposing bail ear, not shown) to give users the ability to carry the containers 450 and 460.

FIG. 5G illustrates an exemplary stack 500 of square-shaped containers 400 sealed with square-shaped container lids 100 on top of a wooden pallet. The nesting satellite ring 416 described above allows for optimal horizontal spacing despite the inclusion of universal plastic handles 428 on each container in the stack 500.

Figure 5I:
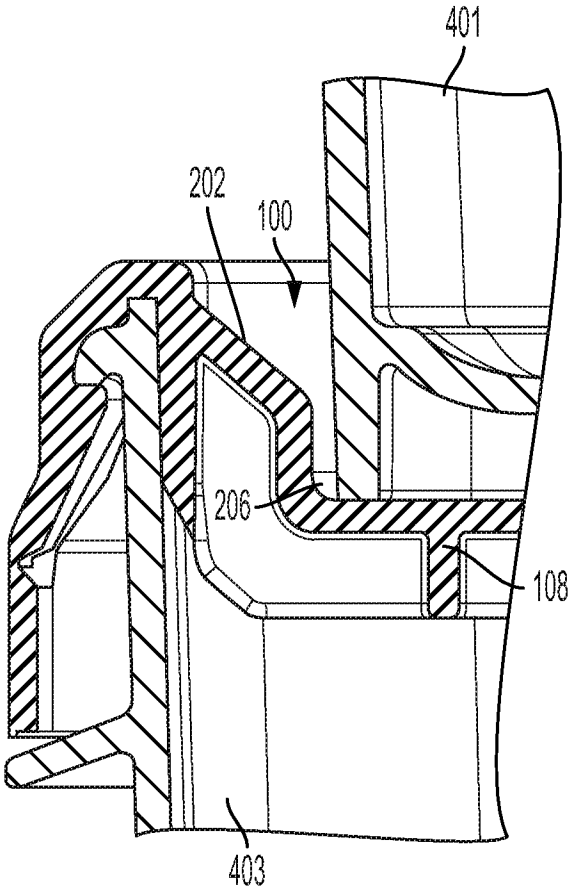
FIGS. 5H and 5I are cross-sectional views of exemplary square-shaped containers and lids in a stacked orientation, according to one embodiment of the present disclosure.
Figure 5H:
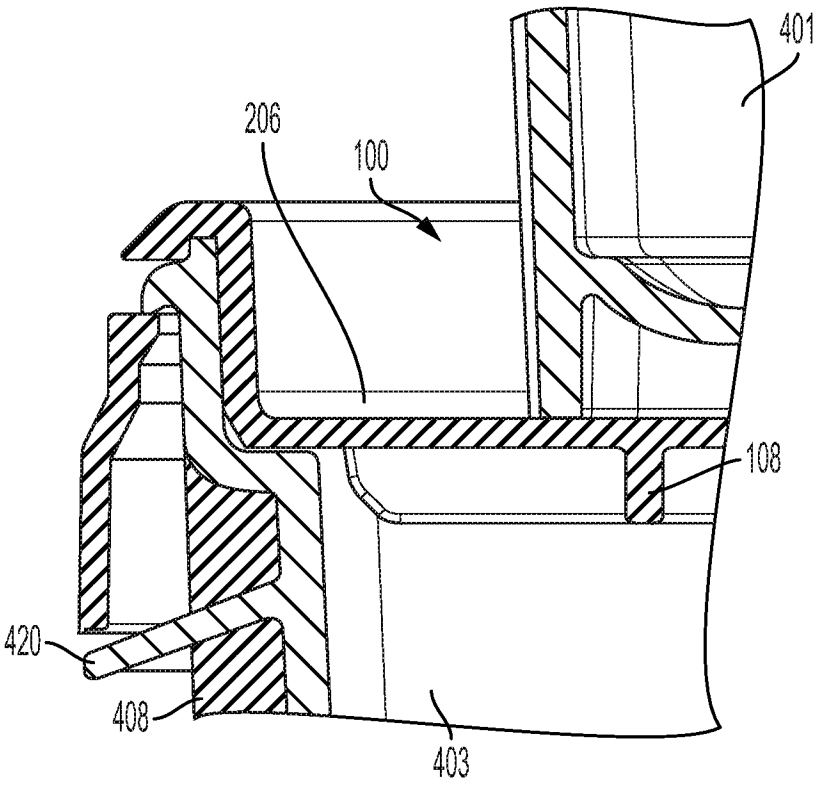

Turning now to FIGS. 5H and 5I, cross-sectional views of a square-shaped container 401, stacked on top of another square-shaped container 403 sealed with a square-shaped container lid 100 are shown, according to one embodiment of the present disclosure. The embodiment shown in FIG. 5H is a cross-sectional corner view, and the embodiment shown in FIG. 5I is a cross-sectional side view.

In the embodiment shown in FIG. 5H, corner ribs 408 of square-shaped container 403 are shown extending down and through or around a tamper evident satellite ring 420 to provide additional support for the weight of square-shaped container 401. In the embodiment shown in FIG. 5I, a square-shaped container 401 sits on top of a cover panel 206 of a square-shaped container lid 100, and is nested securely within a container stack lead-in 202. In Continuing with FIGS. 5H and 5I, the vertical ridges of the brine disc panel 108 provide additional load bearing support for the square-shaped container lid 100 by a providing a mechanism for disbursement of weight throughout the brine disc panel 108.

Circular Lid with Brine Disc

Figure 6A:
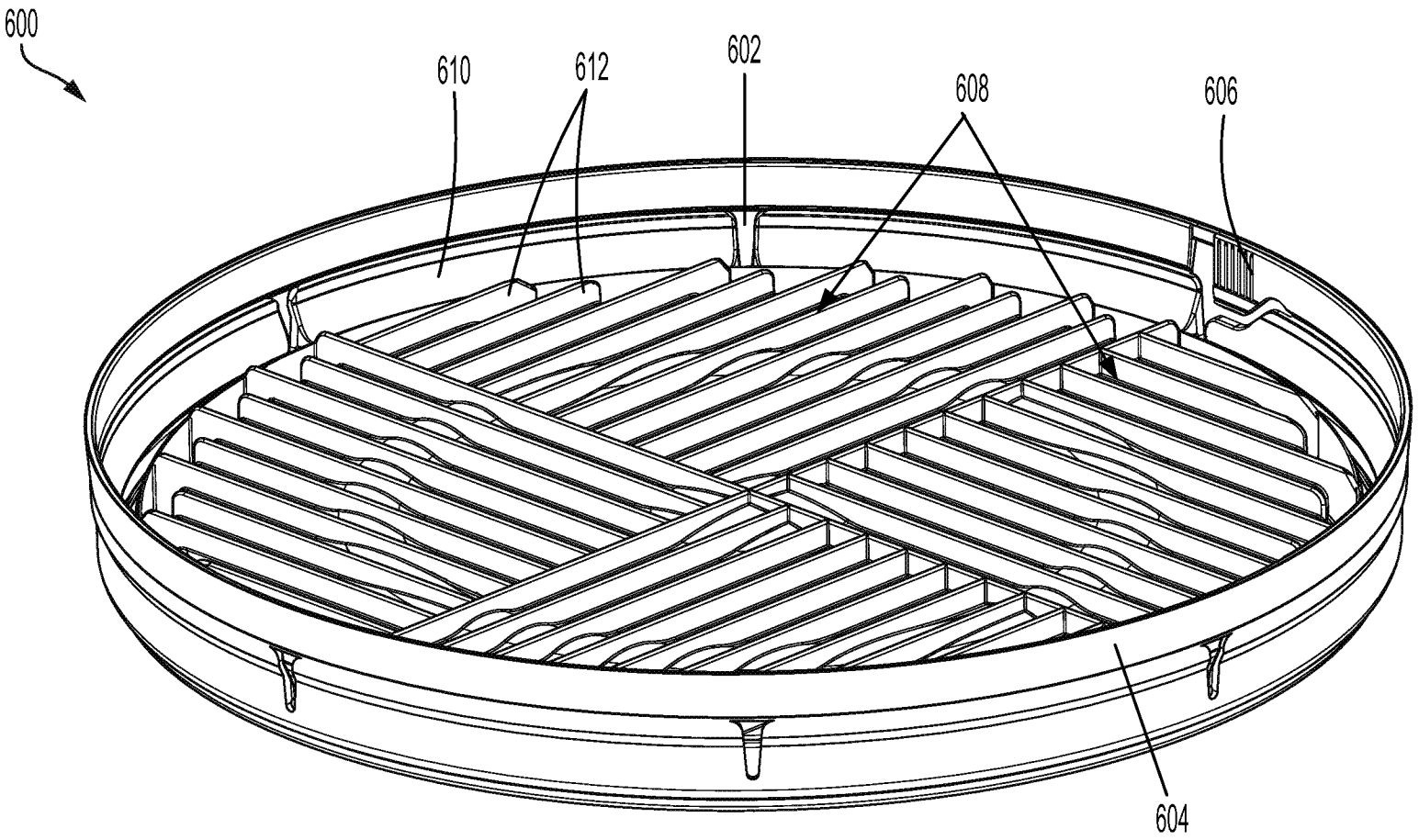
FIGS. 6A, 6B, 6C, and 6D are perspective bottom views of an exemplary circular-shaped container lid, according to one embodiment of the present disclosure.
Figure 6B:
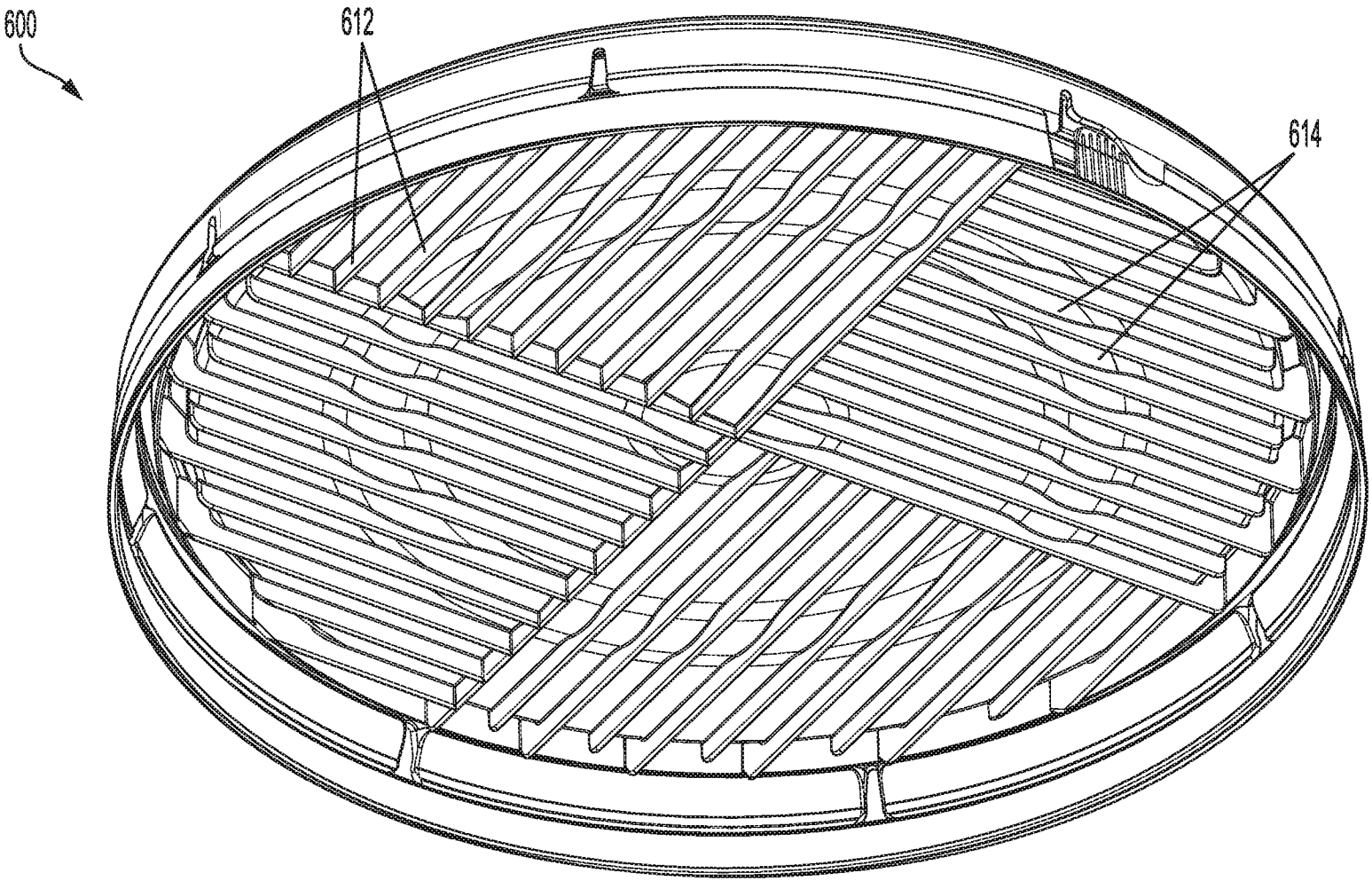

FIGS. 6A, 6B, 6C, and 6D show perspective bottom views of an exemplary circular-shaped container lid 600, according to one embodiment of the present disclosure. Similar to the square-shaped container lid 100, in particular embodiments, the circular-shaped container lid 600 is configured to be securely positioned on top of a container, such as a pickle container, a general bucket for transporting materials, or any other appropriate container. In various embodiments, the circular-shaped container lid 600 is further configured to provide a leak-resistant seal when securely positioned on top of a container, and to push and submerge solids below the surface of any liquids contained within, and filled almost to the top of, the container. According to various aspects of the present disclosure, and as shown in FIG. 6A, the circular-shaped container lid 600 includes a protruding brine disc panel 608 for at least partially providing for the submersion of solids below the surface of liquids contained within a container. In one embodiment, the brine disc panel 608 includes alternating hatched patterns of downward protrusions (e.g., protruding ridges 612) to prevent the lid from "chipping" or "bowing," wherein each pattern occupies an equal amount of the circular-shaped container lid 600 area (e.g., a region). In some embodiments, the alternating hatched patterns of the brine disc panel 608 may occupy unequal amounts of the circular-shaped container lid 600 surface area. In various embodiments, the downward protruding ridges 612 of the brine disc panel 608 can be flat and trapezoidal in shape, such that they rest evenly on container stack lead-ins 702 (shown in FIG. 7) when multiple container lids are in a stacked configuration. In some embodiments, the downward protruding ridges 612 can be rounded, triangular, or any other suitable shape such that chipping or bowing can be prevented, and the brine disc panel 608 can rest on container stack lead-ins 702 (shown in FIG. 7) when in a stacked configuration.

Continuing with FIG. 6A, a tamper evident tear strip 604 is included along the bottom-most portion of the circular-shaped container lid 600. According to various aspects of the present disclosure, the circular-shaped container lid 600 may be secured onto the top of a container with the tear strip 604 intact. Further, a user of the circular-shaped container lid 600 may remove the tear strip 604 by disengaging a tamper evident break tab 606, and peeling the tear strip 604 away from the exemplary circular-shaped container lid 600. In various embodiments, removing the tear strip 604 reveals a plurality of lift tabs 610 that a user may use to grip onto and pull (outward and upward) when removing the circular-shaped container lid 600 from a container. In certain embodiments, removing the tear strip 604 also reveals a plurality of gaps 602 separating the plurality of lift tabs 610. In one embodiment, the plurality of gaps 602 define the length of each of the plurality of lift tabs 610, and allows for a particular portion of the circular-shaped container lid 600 (e.g., a lift tab) to be pulled away from a container for removing the circular-shaped container lid 600. In some embodiments, without the plurality of gaps 602 separating the plurality of lift tabs, removing a circular-shaped container lid 600 may be a cumbersome task for a user. For example, pulling on one of the plurality of lift tabs 610 allows for the portion of the circular-shaped container lid 600 corresponding to the lift tab 610 to become unsealed (e.g., the lift tab disengages from a locking mechanism facilitating the lid seal), because that particular portion may be pulled while the remainder of the circular-shaped container lid 600 remains secured to the container. Continuing with the above example, if the circular-shaped container lid 600 did not include the plurality of lift tabs 610, a user would need to pull a larger portion of the circular-shaped container lid 600 (e.g., an entire side of the lid) to disengage the circular-shaped container lid 600 from a container.

As will be further discussed herein, in various embodiments, the square-shaped container lid 600 may include a cover panel groove (e.g., cover panel groove 706 discussed in relation to FIG. 7) located in the center of a top surface of the square-shaped container lid 600. In the embodiment shown in FIG. 6B, a bottom surface of the cover panel groove 614 can be seen between the downward protruding ridges 612. As will be understood from discussions herein, in at least one embodiment, the bottom surface of the cover panel groove 614 may extend downwardly to a depth that is less than a depth of the downward protruding ridges 612. In further embodiments the bottom surface of the cover panel groove 614 may extend to a depth that is more than a depth of the downward protruding ridges 612 (or more than a depth of a portion of the protruding ridges 612). In still further embodiments, the square-shaped container lid 600 may include a brine disk (e.g., with downward protruding ridges 612), but may not include a cover panel groove 614.

Figure 6C:
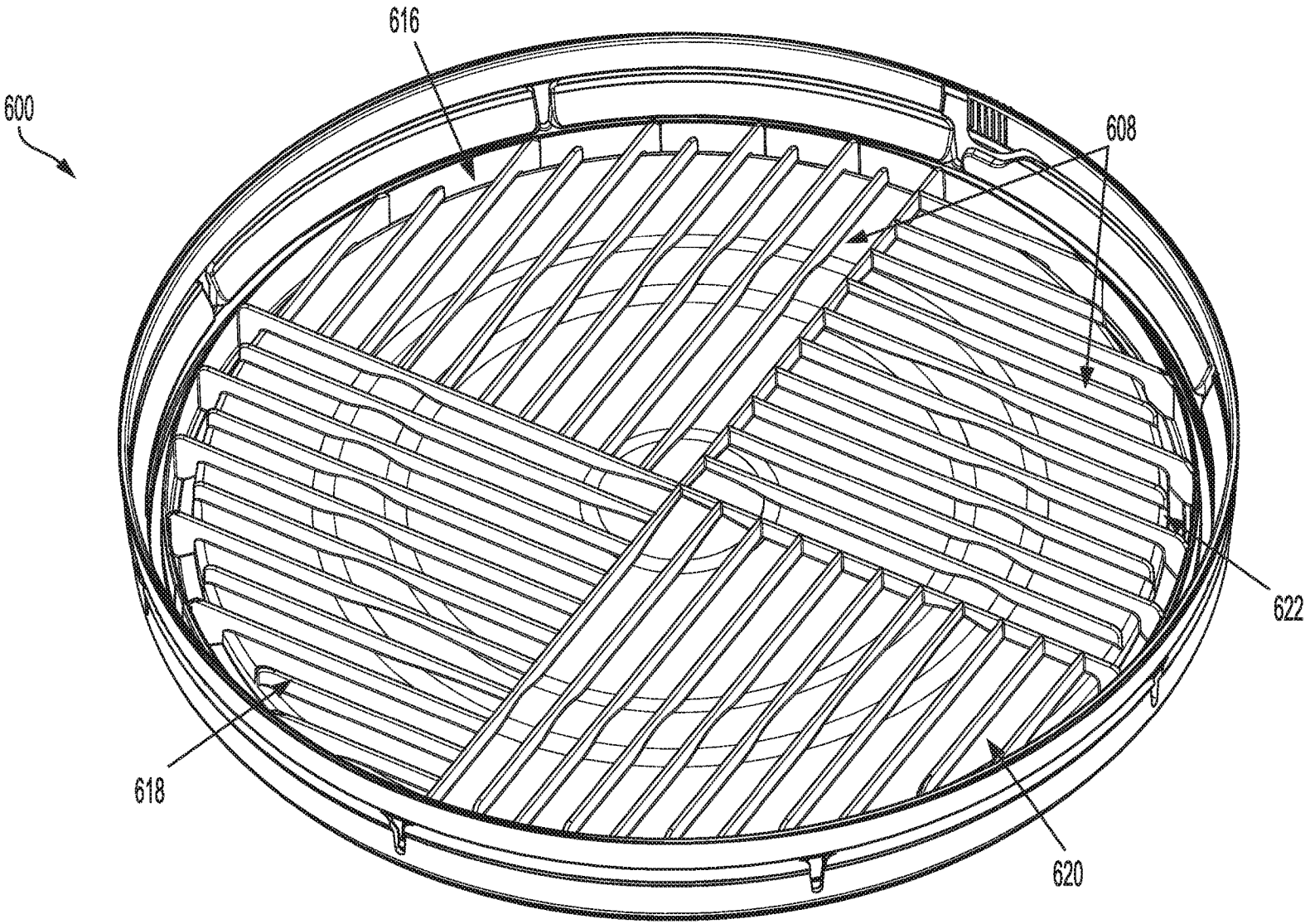
Figure 6D:
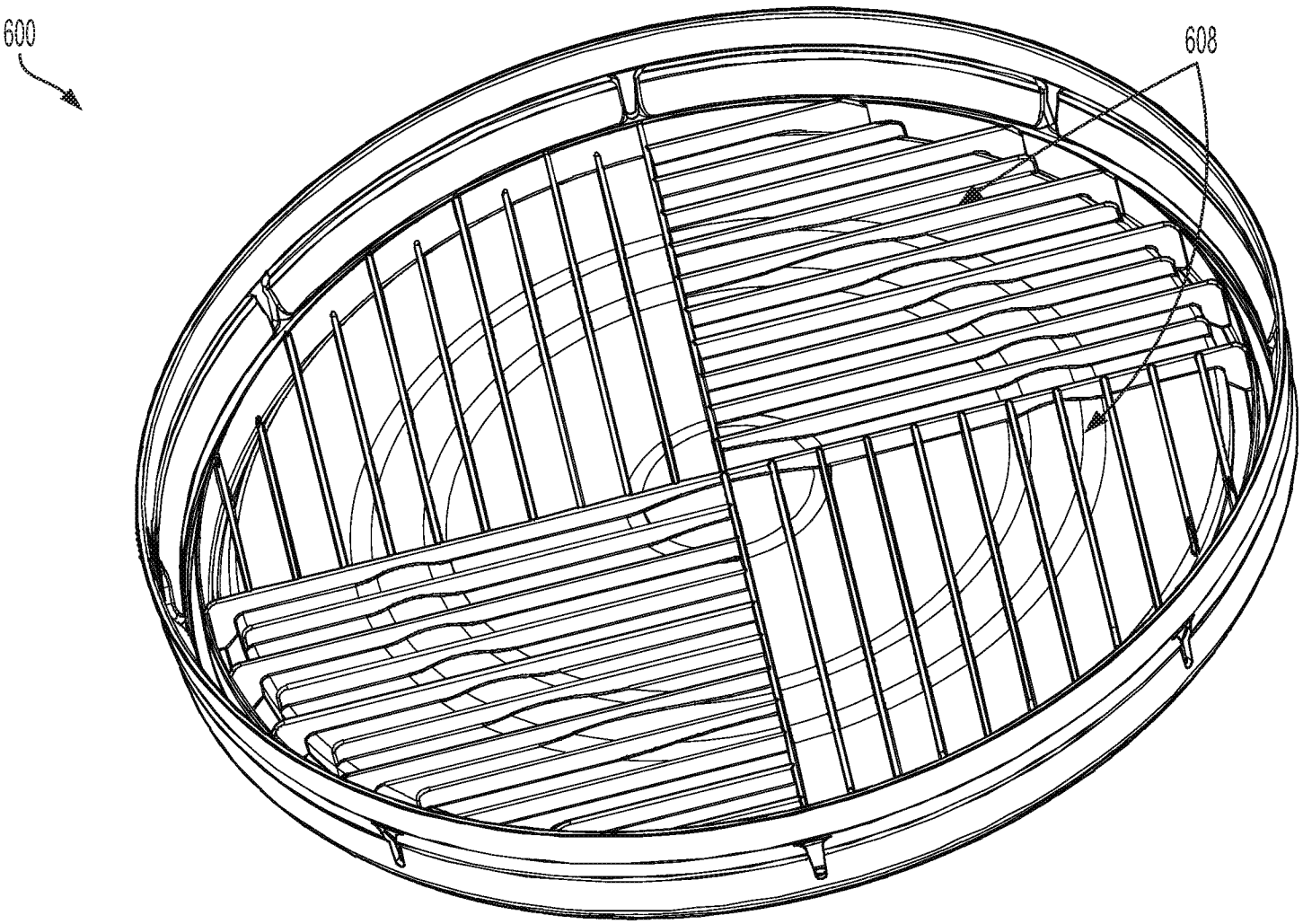

FIGS. 6C and 6D show perspective views of the circular-shaped container lid 600. In the embodiment shown in FIG. 6C, the brine disc panel 608 includes four regions 616, 618, 620, and 622. In certain embodiments, the alternating hatched patterns of the brine disc panel 608 are organized into quadrants. In some embodiments, the alternating hatched patterns of the brine panel 108 are organized into sextants, octants, or any other suitable division of space.

Figure 7:
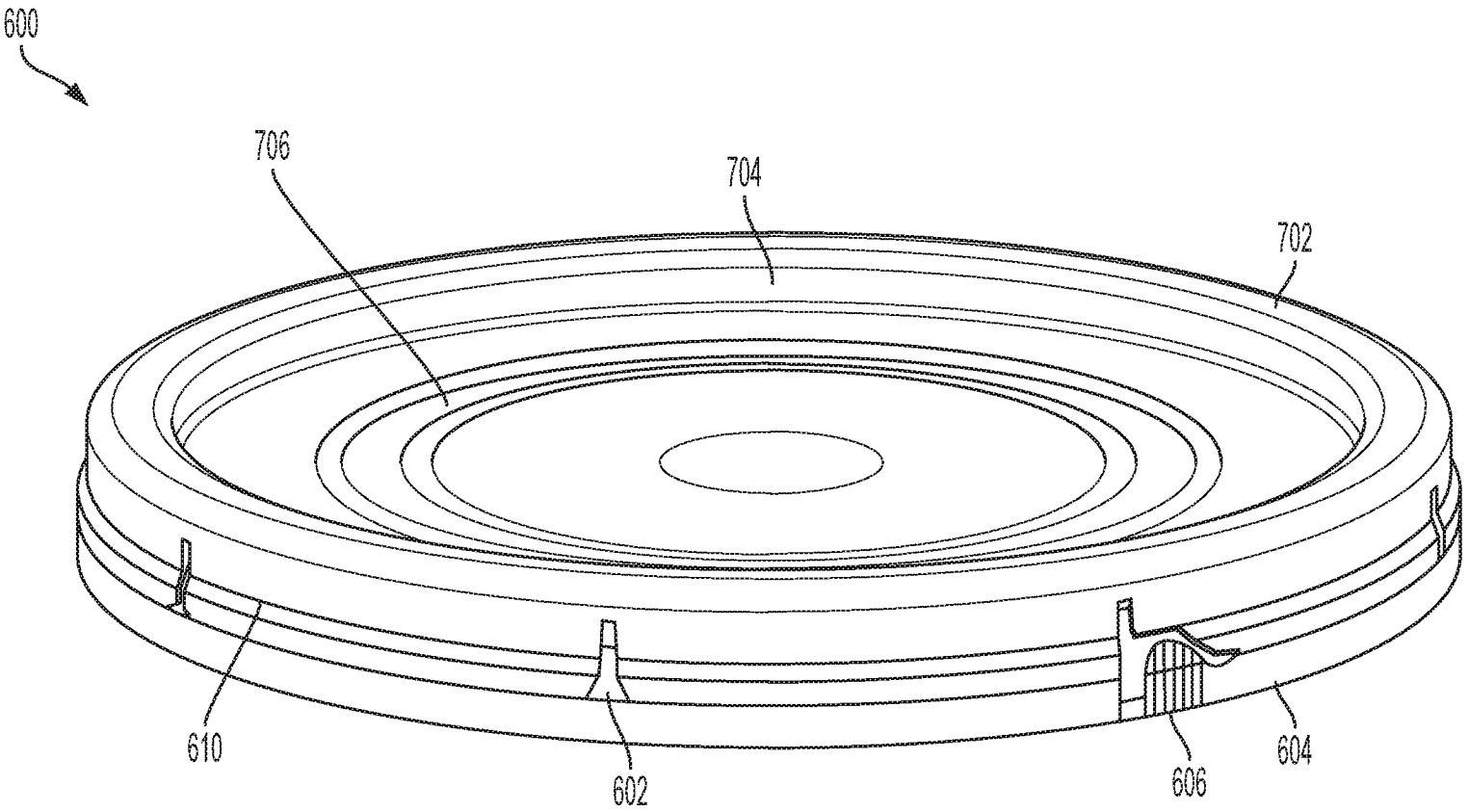
FIG. 7 is a perspective top view of an exemplary circular-shaped container lid, according to one embodiment of the present disclosure.

Turning now to FIG. 7, a perspective top view of an exemplary circular-shaped container lid 600 is shown, according to one embodiment of the present disclosure. In the embodiment shown in FIG. 7, a container stack lead-in 702 is located on the outer brim of the circular-shaped container lid 600. In various embodiments, and as will be further described herein, a container stack lead-in 702 is a protruding feature that provides support when stacking containers (as shown in FIG. 10G), by accepting, and forming a barrier around, the bottom of a container. In one or more embodiments, a cover panel groove 706 is located near the center of a cover panel 704 of the circular-shaped container lid 600. In various embodiments, the cover panel groove 706 may provide rigidity while accepting the bottom portion of an additional container when in a stacked configuration (as shown in FIG. 10G).

Figure 8B:
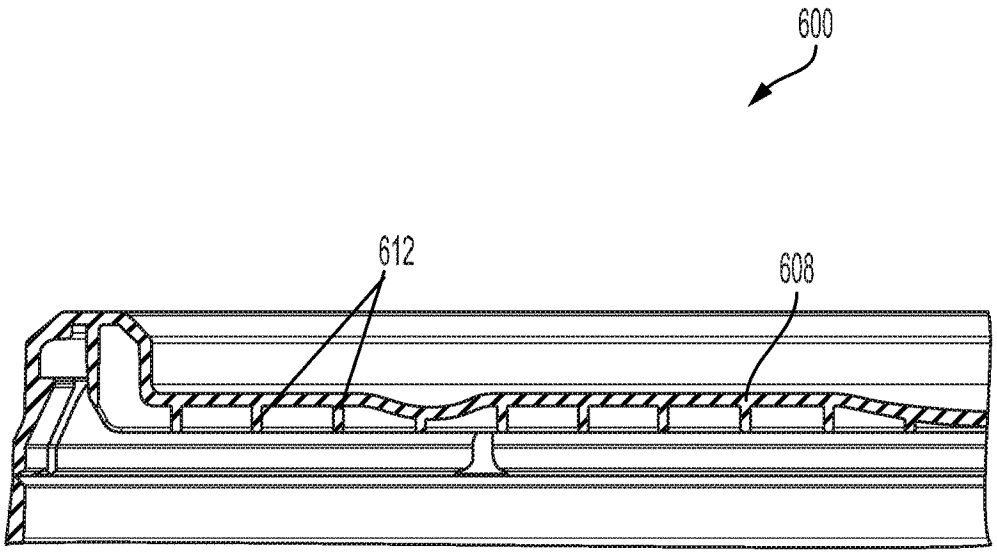
FIGS. 8A and 8B are cross-sectional views of an exemplary circular-shaped container lid, according to one embodiment of the present disclosure.
Figure 8A:
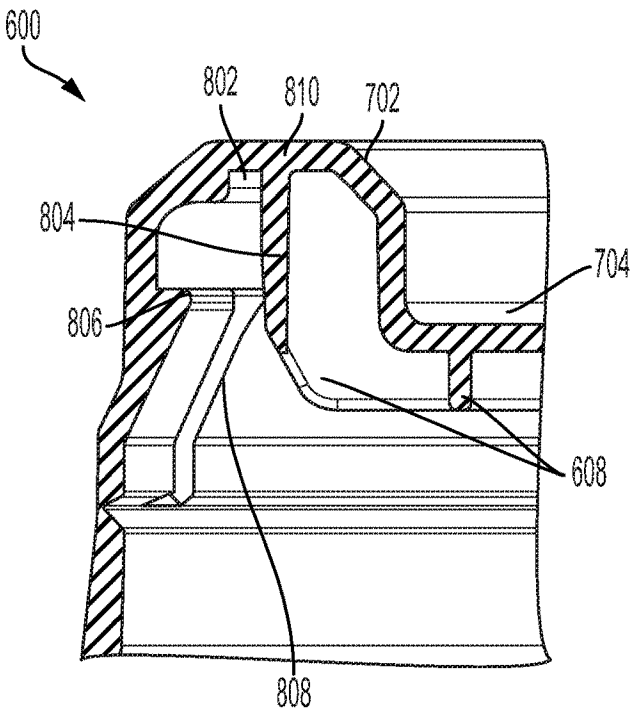

Referring now to FIG. 8A, a cross-sectional view of an exemplary circular-shaped container lid 600 is shown, according to one aspect of the present disclosure. In particular embodiments, a cover inner skirt 804 forms one side wall of a seal portion 808. In one embodiment, the seal portion 808 is flanked by the cover inner skirt 804 forming one side wall, a cover undercut 806 forming an opposite side wall, and a gasket-less seal feature 802 connecting the two side walls at the top of the circular-shaped container lid 600, and forming an enclosure. In particular embodiments, the gasket-less seal feature 802 works in tandem with a corresponding gasket-less seal bead 912 on a container (shown in FIG. 9A, to come together to form a tight seal without the need for a gasket. The gasket-less container bead 912 will be described in more detail herein.

Continuing with this embodiment, a flat edge 810 extends across the top circumference of the circular-shaped container lid 600. In particular embodiments, the flat edge 810 may be parallel to the cover panel 704 and provides a stabilizing mechanism for the container stack lead-in 702, the cover undercut 806, and the cover inner skirt 804.

FIG. 8B shows a cross-sectional view of an exemplary circular-shaped container lid 600, according to one embodiment of the present disclosure. In various embodiments, the cross-section illustrated in FIG. 8B shows a substantially constant distance between the ridges 612 of the brine disc panel 608, which helps remedy the problem that traditional flat container lids have with "chipping" and "bowing" over time. In one or more embodiments, the distance between ridges 612 can fluctuate, as well as the alternating pattern of the brine disc panel 608, in order to achieve optimal stability of the circular-shaped container lid 600.

Figure 8C:
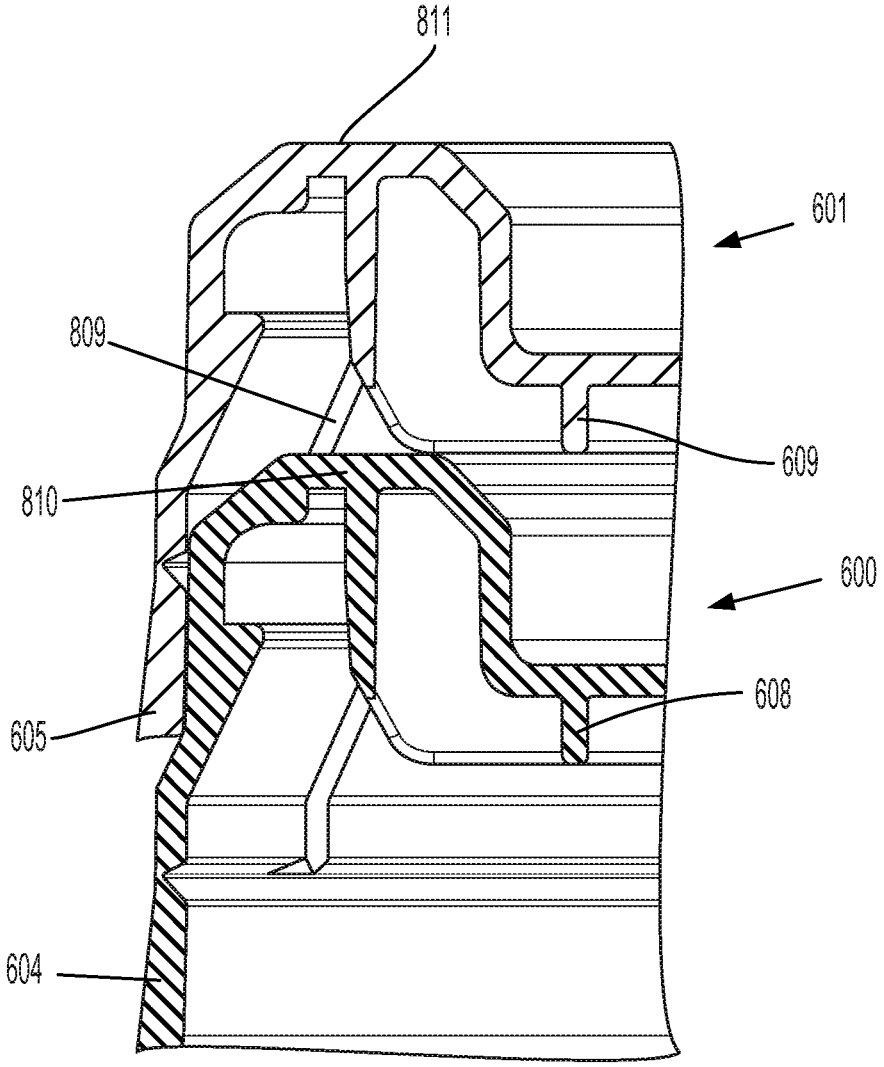
FIG. 8C is a cross-sectional view of exemplary circular-shaped container lids in a stacked orientation, according to one embodiment of the present disclosure.

FIG. 8C shows a cross-sectional view of two exemplary circular-shaped container lids 600 and 601 in a stacked orientation, according to one embodiment of the present disclosure. In one embodiment, a flat edge 810 of the bottom circular-shaped container lid 600 serves as a base for the seal portion 809 and portions of the brine disc panel 609 of the top circular-shaped container lid 601 to rest securely on top of. In a particular embodiment, the distance between the bottom of the tear strip 605 on the top circular-shaped container lid, and the bottom of the tear strip 604 on the bottom circular-shaped container lid 600 is at least approximately one-half of an inch.

Circular Container

Figure 9A:
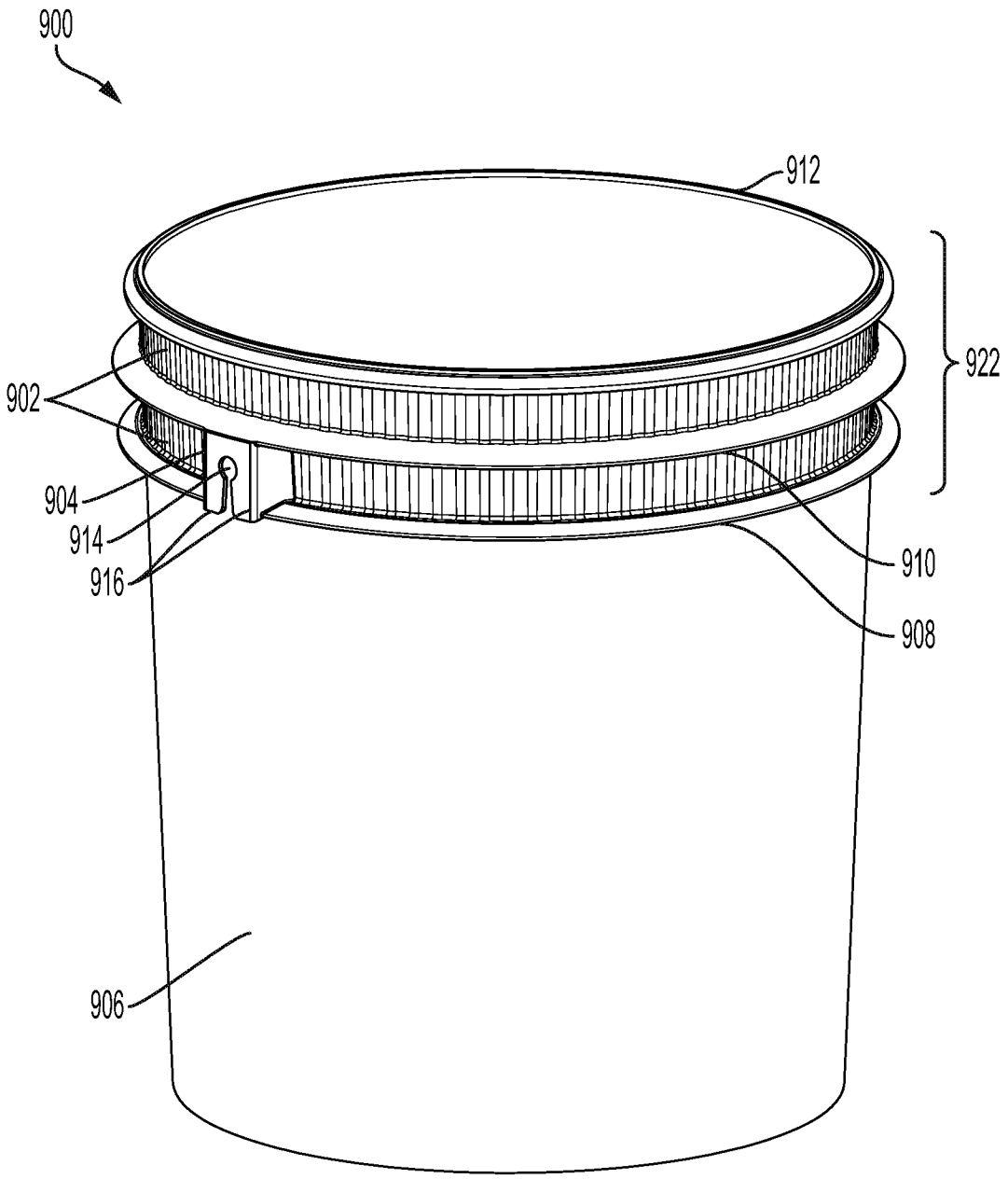
FIG. 9A is a perspective view of an exemplary circular-shaped container, according to one embodiment of the present disclosure.

Turning now to FIG. 9A, a perspective view of an exemplary circular-shaped container 900 is shown, according to one embodiment of the present disclosure. In one embodiment, the exemplary circular-shaped container 900 includes a large billboard 906 on the exterior of the circular-shaped container 900 that provides a solid base for stability. In particular embodiments, the circular-shaped container 900 includes corrugated side walls 902 for additional stability, and one or more satellite rings 908 and 910 around the upper portion of the circular-shaped container 900. In various embodiments, the rim of the circular-shaped container 900 includes a square-shaped (from a cross-sectional perspective, not shown in FIG. 9A) gasket-less container bead 912 to provide a gasket-less seal when a circular-shaped container lid 600 is attached.

Continuing with FIG. 9A, in particular embodiments, a circular-shaped container 900 may include a bumper assembly 922 to protect the circular-shaped container 900 when it comes into contact with other objects. The bumper assembly may include one or more satellite rings 908 and 910. In one embodiment, the bumper assembly includes two satellite rings: a nesting satellite ring 908 and a general satellite ring 910. In various embodiments, the nesting satellite ring 908 prevents circular-shaped containers from sticking together when in a stacked configuration by providing a barrier around the outer edge of the container. In particular embodiments, the general satellite ring 910 provides added support for the bail ears 904, and provides a mechanism for lifting the container 900 without a handle.

Continuing with FIG. 9A, in particular embodiments, the circular-shaped container 900 includes an active bail ear 904 and an additional active bail ear on an opposite side wall of the exterior of the circular-shaped container 900 (additional active bail ear not shown in FIG. 9A). In the embodiment shown, active bail ear 904 is centrally located between the general satellite ring 910 and the nesting satellite ring 908. In various embodiments, each bail ear includes an opening 914 that can be of varying sizes, and allows for the attachment of a handle that can be used for carrying the circular-shaped container 900. Each bail ear, in particular embodiments, includes vertical support structures 916 for additional load bearing support when a handle is used to carry the circular-shaped container 900.

Additionally, the circular-shaped container 900 embodiment shown in FIG. 9A includes a gasket-less container bead 912 located around the rim of the circular-shaped container 900. In the event a circular-shaped container lid 600 is used to seal the circular-shaped container 900, a gasket-less seal feature 802 (as discussed in relation to FIG. 8A) included in the circular-shaped container lid 600 accepts a gasket-less container bead 912 located around the rim of the circular-shaped container 900. In a particular embodiment, the gasket-less container bead 912 is generally square-shaped, such that when it is engaged with the gasket-less seal feature 802, it forms a liquid-tight seal without the use of additional gaskets. In one or embodiments, the gasket-less container bead 912 may be rectangular or any other suitable shape.

Figure 9B:
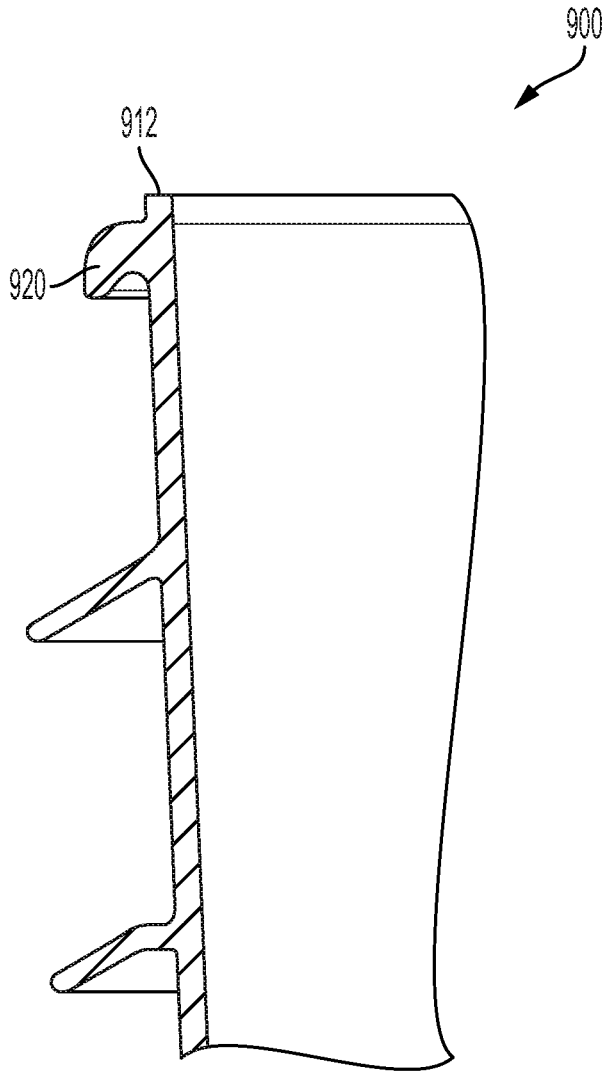
FIG. 9B is a cross-sectional view of an exemplary circular-shaped container, according to one embodiment of the present disclosure.

FIG. 9B shows a cross-sectional view of the upper portion of the circular-shaped container 900, according to one embodiment of the present disclosure. In one or more embodiments, the circular-shaped container includes a rim hook 920 that a plurality of lift tabs 610 (shown in FIG. 6A) on a circular-shaped container lid 600 (shown in FIG. 6A) can latch onto to provide for a tight seal. In various embodiments, the rim hook 920 is located below a gasket-less container bead 912 around the outer rim of the circular-shaped container 900. In some embodiments, the rim hook 920 extends outward and downward from the circular-shaped container to form a hooking mechanism. In various embodiments, the rim hook 920 may include a pointed portion and a curved upper portion.

Figure 9C:
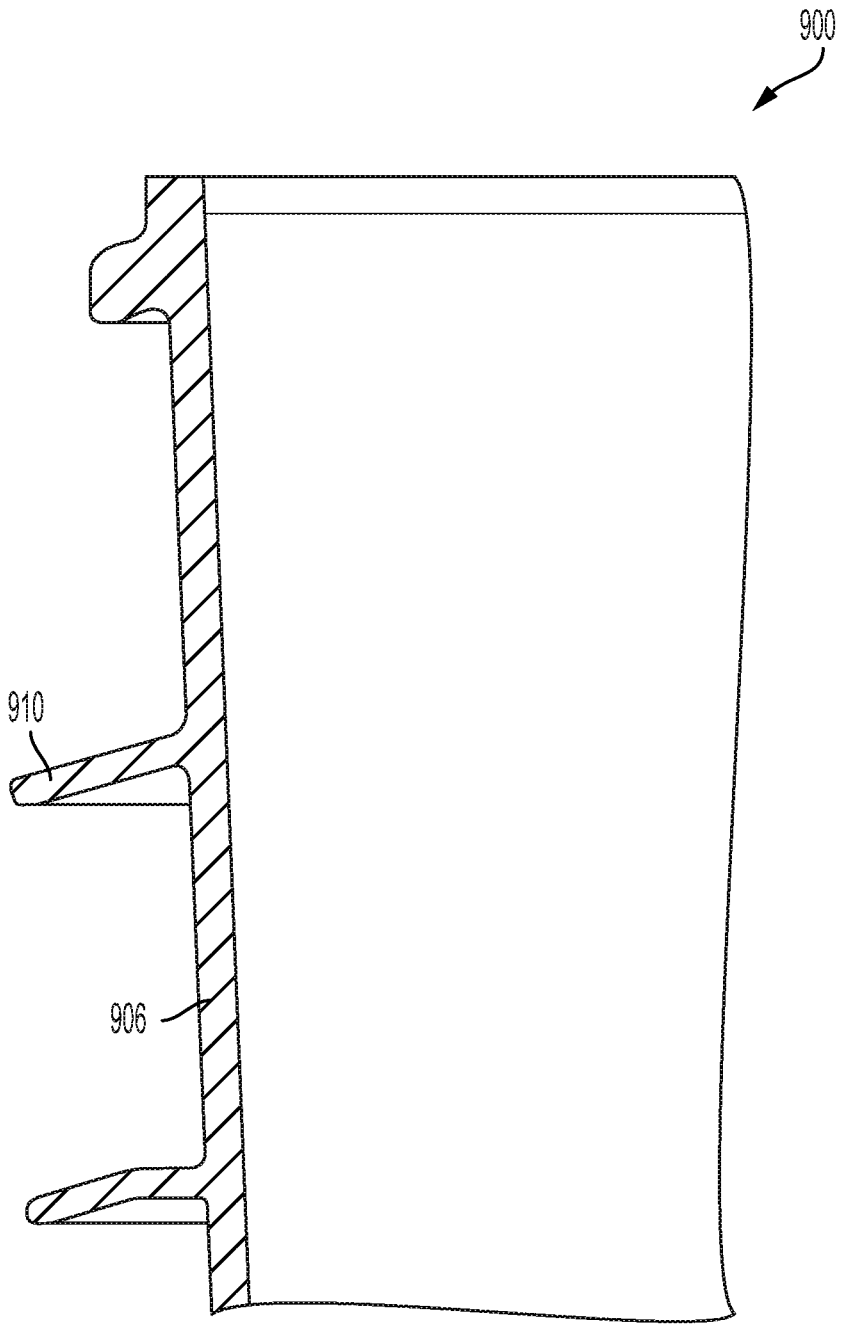
FIG. 9C is a cross sectional view of an exemplary circular-shaped container, according to one embodiment of the present disclosure.

Now referring to FIG. 9C, a cross-sectional view of an upper portion of the circular-shaped container 900 is shown, according to one embodiment of the present disclosure. In one embodiment, the circular-shaped container 900 includes a general satellite ring 910 around its circumference that protrudes out from the container substantially perpendicular to a billboard 906, and then bends downward at an angle less than or equal to forty-five degrees. In one or more embodiments, the circular-shaped container includes a rim hook 920 with a substantially flat bottom that forms a shallow hooking mechanism. In certain embodiments, the rim hook 920 may include a substantially flat bottom portion and a curved upper portion.

In one embodiment, the circular-shaped container 900 includes a tamper evident satellite ring (not shown) around its circumference that works in tandem with a tamper evident tear strip 604 included on the circular-shaped container lid 600. In the event the circular-shaped container lid 600 is used to seal the circular-shaped container 900, in various embodiments, the tamper evident tear strip 604 is positioned about the tamper evident satellite ring, such that the tamper evident satellite ring serves as a barrier to prevent any attempts to remove the circular-shaped container lid 600 by reaching under the tamper evident tear strip 604.

Figure 10B:
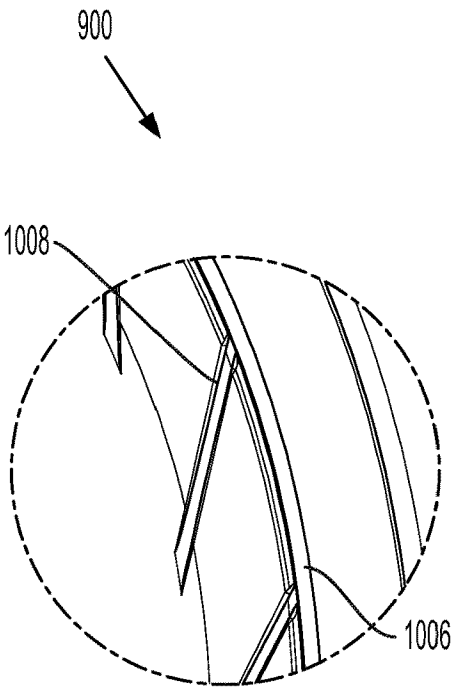
FIGS. 10A and 10B are top views of an exemplary circular-shaped container, according to one embodiment of the present disclosure.
Figure 10A:
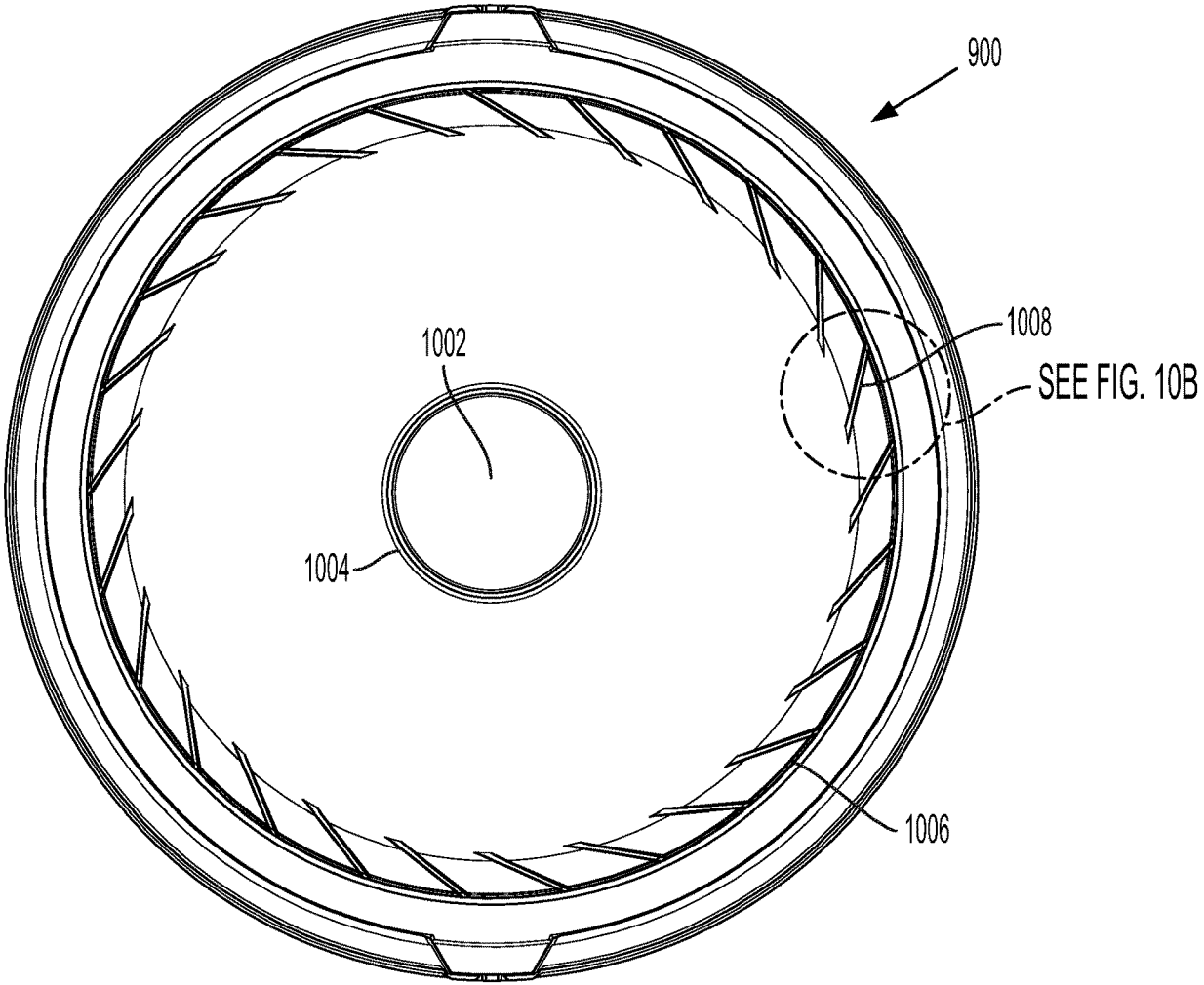

Turning now to FIGS. 10A and 10B, a top view of an exemplary circular-shaped container 900 is shown, according to one embodiment of the present disclosure. In one embodiment, the exemplary circular-shaped container 900 includes a container bottom dimple 1002 to increase stability and facilitate the stacking of one or more circular-shaped containers 900 secured with circular-shaped container lids 600 (as shown in FIG. 10G). In the embodiment shown in FIG. 10A, the container bottom dimple 1002 is circular in shape. However, in various embodiments, a container bottom dimple 1002 may be of any suitable size or shape.

In one or more embodiments, a circular-shaped container 900 includes a container gate protector ring 1004 around the circumference of the container bottom dimple 1002 to further facilitate stability when sealed containers are in a stacked configuration. In particular embodiments, when circular-shaped containers 900 sealed with circular-shaped container lids 600 are in a stacked configuration, the container bottom dimple 1002 fits into the cover panel groove 704 (shown in FIG. 7) of the circular-shaped container lid 600 to stabilize and provide better load support when stacking.

Continuing with FIGS. 10A and 10B, in various embodiments, a circular-shaped container 900 includes one or more chimes 1006 to facilitate protection of the circular-shaped container 900, such that it is not easily damaged when handled. In one or more embodiments, the one or more chimes 1006 is also configured to help stabilize the circular-shaped container when in a stacked configuration.

Still referring to FIGS. 10A and 10B, in at least one embodiment, a circular-shaped container 900 includes container bottom ribs 1008 to disperse pressure and provide additional strength in load bearing scenarios. In the embodiment shown, the container bottom ribs 1008 are not perpendicular to either the inner sidewall or to the container 900 bottom. However in one or more embodiments, the container bottom ribs (if present) may be perpendicular to the inner sidewall of the container 900 bottom. Additionally, in various embodiments, the container bottom ribs may be connected to the inner sidewall and/or the container bottom at an angle less than ninety degrees.

Figure 10D:
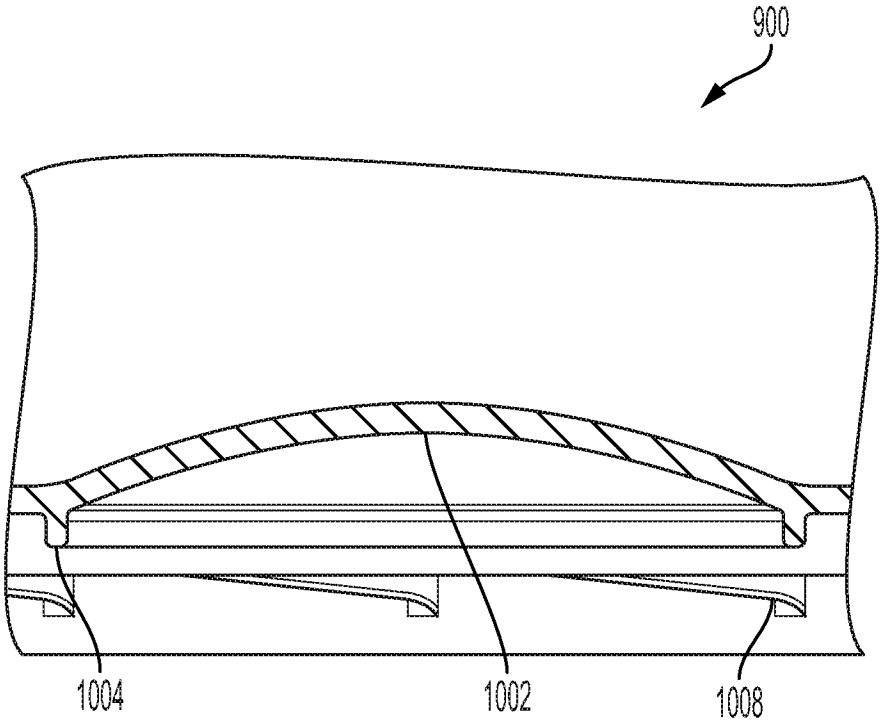
FIGS. 10C and 10D are cross-sectional views of an exemplary circular-shaped container, according to one embodiment of the present disclosure.
Figure 10C:
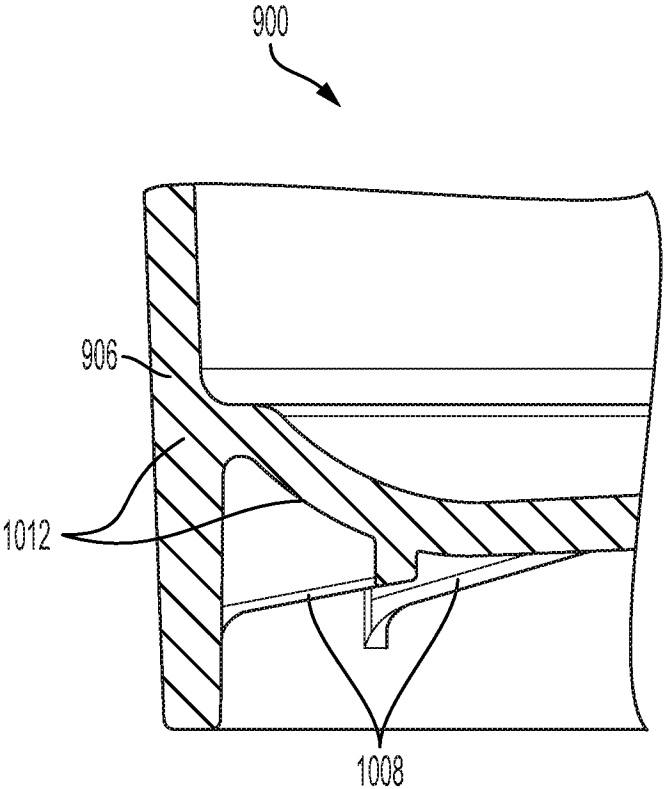

Turning now to FIGS. 10C and 10D, cross-sectional views of the bottom portion of a circular-shaped container 900 are shown, according to one embodiment of the present disclosure. As shown in FIG. 10C, in various embodiments, the circular-shaped container 900 includes side contours 1012, which are curvatures at the juncture where the bottom of the container connects to a billboard 906. In one or more embodiments, the side contours 1012 provide impact strength for the circular-shaped container 900. Further, in the embodiments shown in FIGS. 10C and 10D, container bottom ribs 1008 are generally triangularly shaped. In one or more embodiments, the container bottom ribs 1008 may be rectangular shaped, or any other appropriate shape. In some embodiments, the container 900 includes no bottom ribs 1008.

Figure 10F:
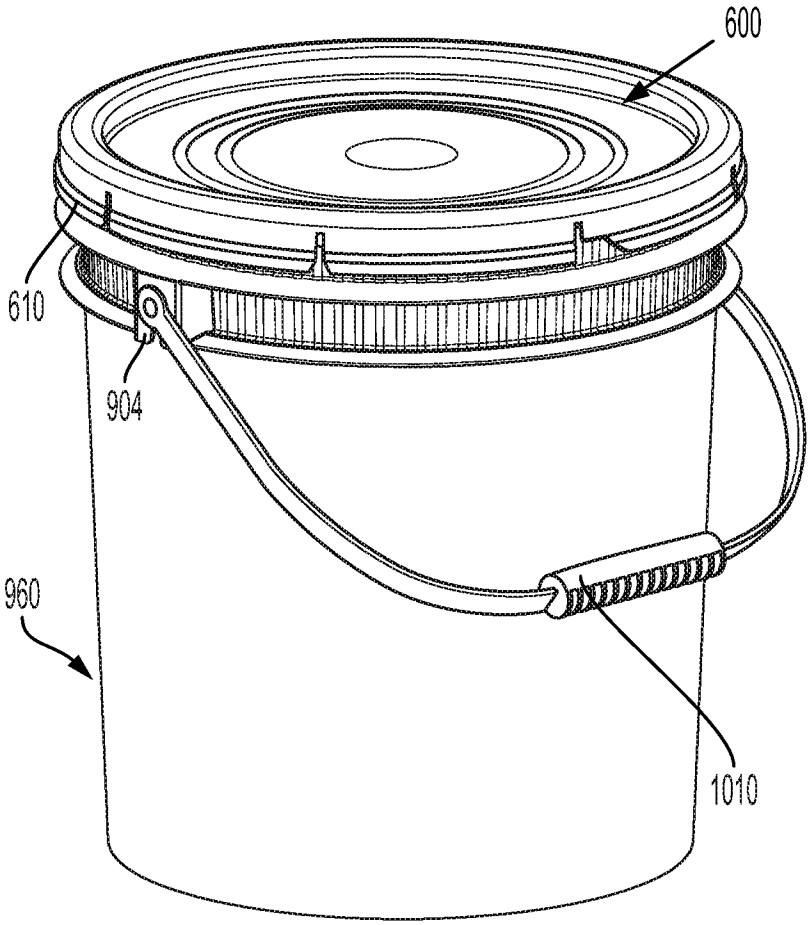
FIGS. 10E and 10F are perspective views of exemplary circular-shaped containers and lids, according to one embodiment of the present disclosure.
Figure 10E:
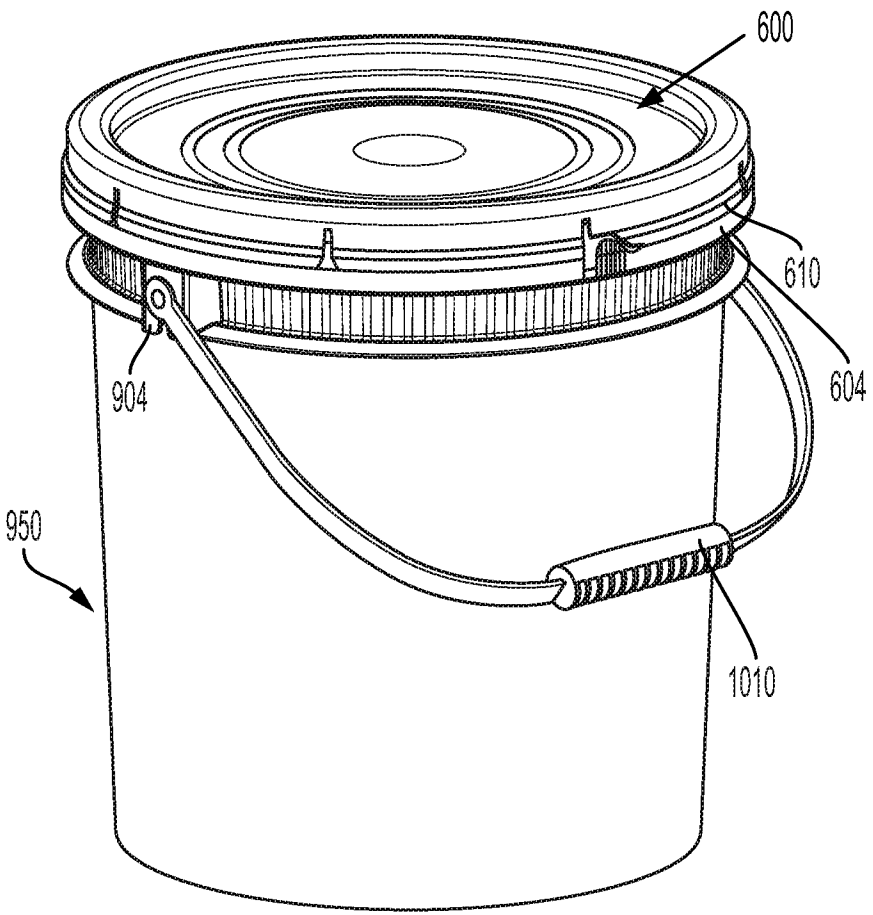
Figure 10G:
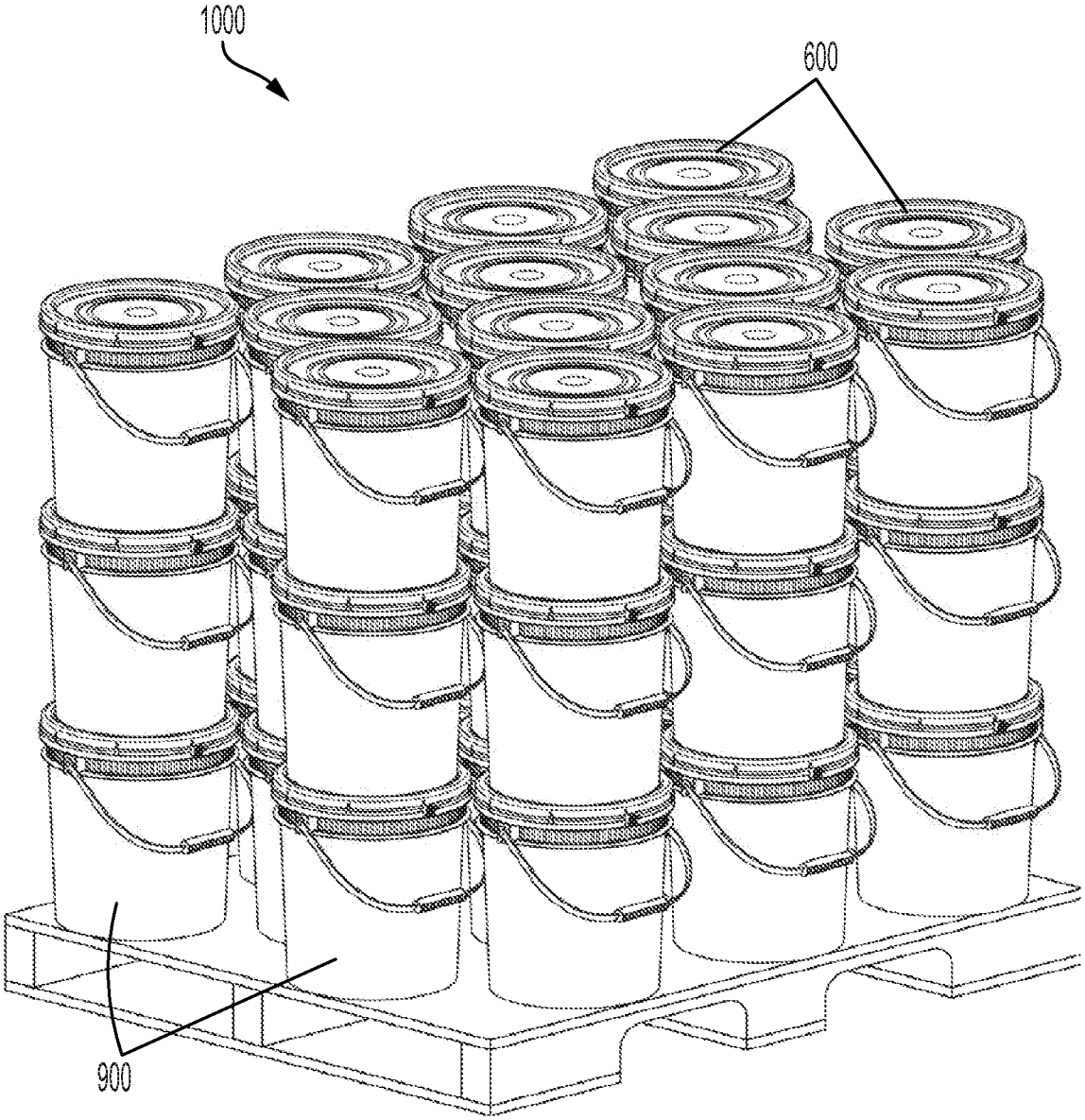
FIG. 10G is a perspective view of exemplary circular-shaped containers and lids in a stacked orientation, according to one embodiment of the present disclosure.

FIGS. 10E and 10F show circular-shaped containers 950 and 960 sealed with circular-shaped container lids 600, according to one embodiment of the present disclosure. FIG. 10E shows a circular-shaped container 950 completely sealed with a circular-shaped container lid 600, such that a tamper evident tear strip 604 is attached to lift tabs 610 indicating that the sealed circular-shaped container 950 that has never been opened. Continuing with the embodiments shown in FIGS. 10E and 10F, FIG. 10F also includes a circular-shaped container 960 sealed with a circular-shaped container lid 600. In this embodiment, the circular-shaped container lid 600 is shown with lift tabs 610, but does not include a tamper evident tear strip 604, which indicates the original seal has been broken. Additionally, as shown in FIGS. 10E and 10F according to one embodiment of the present disclosure, a plastic handle 1010 is attached to bail ears 904 to give users the ability to carry the containers 950 and 960.

FIG. 10G illustrates an exemplary stack 1000 of circular-shaped containers 900 sealed with circular-shaped container lids 600 on top of a wooden pallet. In certain embodiments, each container includes a nesting satellite ring (e.g., nesting satellite ring 908 described herein) allows for optimal horizontal spacing despite the inclusion of handles (e.g., plastic handles 1010 described herein) on each container in the stack 1000.

Figure 10H:
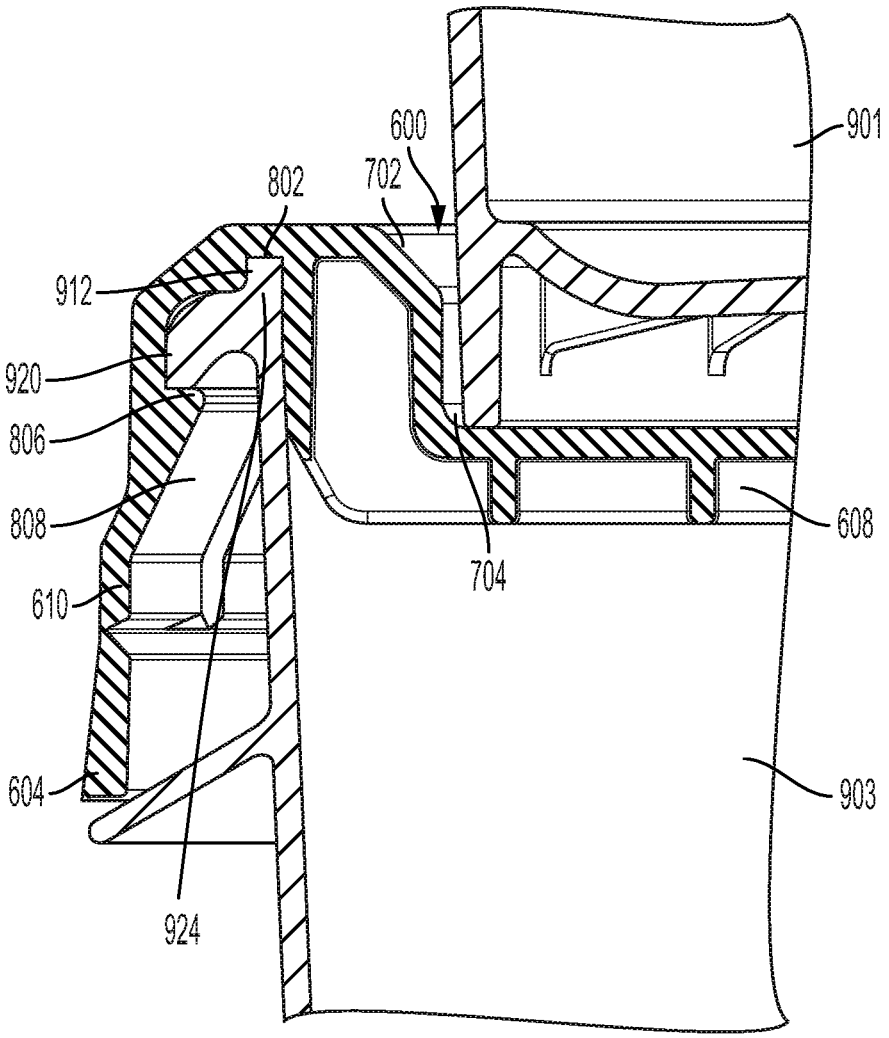
FIG. 10H is a cross-sectional view of exemplary circular-shaped containers and lids in a stacked orientation, according to one embodiment of the present disclosure.

Turning now to FIG. 10H, a cross-sectional view of a circular-shaped container 901 stacked on top of another circular-shaped container 903 sealed with a circular-shaped container lid 600 is shown, according to one embodiment of the present disclosure. As shown in the present embodiment, a circular-shaped container 900 sits on top of a cover panel 704 of a circular-shaped container lid 600, and is nested between container stack lead-ins 702. Continuing with this embodiment, the vertical ridges of a brine disc panel 608 provide additional load bearing support for the circular-shaped container lid 600.

In various embodiments, a cover undercut 806 protrudes upward from lift tab 610 and into a seal portion 808. Continuing with this embodiment, in the event the circular-shaped container lid 600 is used to seal a container, the rim 924 of the container enters the seal portion 808 and forms a seal when a gasket-less seal feature 802 engages with a gasket-less container bead 912. In particular embodiment, the sloping shape of the cover undercut 806 facilitates affixing container lids to containers. Further continuing with this embodiment, once a seal is established, or before a seal is established, the cover undercut 806 locks into place around a rim hook 920 located around the circumference of a container. As mentioned above, in order to remove the circular-shaped container lid 600 once a seal is established, a user pulls and removes a tear strip 604 from the circumference of the circular-shaped container lid 600 to reveal the plurality of lift tabs (e.g., lift tab 610 shown in FIG. 10G). The user can then remove the circular-shaped container lid 600 by pulling outward and upward on the plurality of lift tabs 610.

Figure 11:
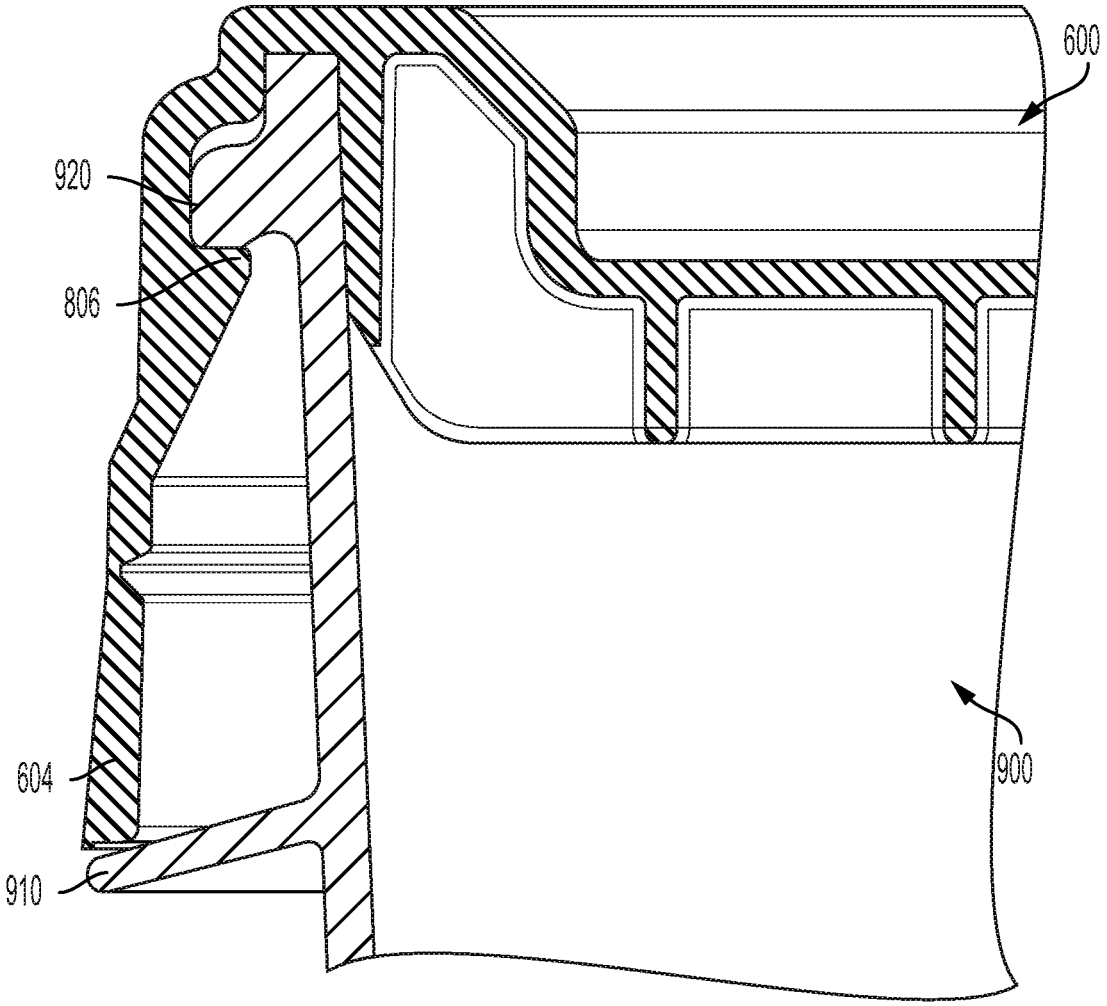
FIG. 11 is a cross-sectional view of an exemplary circular-shaped container sealed with an exemplary circular-shaped container lid according to one embodiment of the present disclosure.

FIG. 11 illustrates a cross-sectional view of an exemplary circular-shaped container 900 sealed with an exemplary circular-shaped container lid 600, according to one embodiment of the present disclosure. In some embodiments, once a seal is established, or before a seal is established, a cover undercut 806 locks into place around a rim hook 920 located around the circumference of a container, such that the flat bottom portion of the rim hook 920 rests flush against the flat upper portion of the cover undercut 806. In various embodiments, a tamper evident tear strip 604 extends downward from a container lid 600 until it comes into contact, or nearly comes into contact, with a general satellite ring 910.

Alternate Embodiments

In at least one embodiment, the brine disc discussed herein includes protrusions in any suitable pattern and/or protrusions in any suitable shape such that fluid can pass around/through the protrusions and the pattern of protrusions may help prevent lids from chipping. In one example, in one embodiment, a container lid discussed herein may include arced protrusions (opposed to substantially linear protrusions), protrusions with a bend (e.g., a 30, 60, and/or 90 degree bend), more than one bend (e.g., a protrusions in a zig-zag shape). In further embodiments, the brine disc includes a single or only a few protrusions with slots, cut outs, holes, or the like to allow fluid to pass around portions of these protrusions.

As will be understood, the various features discussed herein may be used with different shaped containers and lids, such as, for example, substantially rectangular containers and lids, substantially obround containers and lids, etc.

Conclusion

Accordingly, it will be readily understood by those persons skilled in the art that, in view of the above detailed description of the various embodiments and articles of the present disclosure, the present disclosure is susceptible of broad utility and application. Many methods, embodiments, and adaptations of the present disclosure other than those herein described, as well as many variations, modifications, and equivalent arrangements will be apparent from or reasonably suggested by the present disclosure and the above detailed description thereof, without departing from the substance or scope of the present disclosure. Accordingly, while the present disclosure is described herein in detail in relation to various embodiments, it is to be understood that this detailed description is only illustrative and exemplary of the present disclosure and is made for purposes of providing a full and enabling disclosure of the present disclosure. The detailed description set forth herein is not intended nor is to be construed to limit the present disclosure or otherwise to exclude any such other embodiments, adaptations, variations, modifications, and equivalent arrangements of the present disclosure. The scope of the present disclosure is defined solely by the claims appended hereto and the equivalents thereof.

What is claimed is:

1. A container lid comprising:

a seal portion along a perimeter of a body, the seal portion for receiving an edge of a container;

a tear strip removeably connected to the seal portion;

one or more lift tabs accessible upon removal of the tear strip;

a cover panel groove defined by a top surface of the body, the cover panel groove comprising a sloping portion that slopes downwardly to a centerline of the cover panel groove; and a plurality of protrusions protruding from a bottom surface of the body to a particular depth, wherein:

the body includes four regions defined by two perpendicular axes, each axis of the two perpendicular axes passing through a central point of the body;

the plurality of protrusions are arranged such that at least one of the plurality of protrusions are within each of the four regions;

each of the plurality of protrusions has a length greater than the particular depth; and the length of any protrusion within one of the four regions is perpendicular to the length of any protrusion within an adjacent region of the four regions.

2. The container lid of claim 1, wherein each of the four regions includes at least two protrusions, the at least two protrusions in each region spaced such that a fluid can pass between the at least two protrusions.

3. The container lid of claim 2, wherein a centerline along a longest portion of each protrusion of the plurality of protrusions is parallel to one of the axes.

4. The container lid of claim 1, wherein:

the bottom surface is at a first depth;

a bottom surface of the cover panel groove is at a second depth; and the second depth is greater than the first depth.

5. The container lid of claim 4, wherein the particular depth is greater than the second depth.

6. The container lid of claim 5, wherein the container lid further comprises one or more lead-in features, each of the one or more lead-in features comprising a downward slope from a top portion of the respective lead-in portion to the top surface.

7. The container lid of claim 6, wherein at least a portion of one of the plurality of protrusions extends from a bottom surface of the one or more lead-in features.

8. The container lid of claim 7, wherein:

one or more protrusions of the plurality of protrusions include a sloping portion; and the sloping portion of the one or more protrusions and the downward slope of the one or more lead-in features are substantially similar slopes.

9. The container lid of claim 8, wherein the container lid has a nesting height of about 0.75 inches.

10. The container lid of claim 1, wherein the seal portion comprises a gasket-less seal.

11. The container lid of claim 1, wherein the container lid is substantially circular.

12. The container lid of claim 1, wherein the container lid is substantially rectangular.

13. The container lid of claim 12, wherein the substantially rectangular container lid further comprises a corner window, wherein the corner window is defined by the seal portion and exposes an interior area of the seal portion.

14. A container lid comprising:

a body comprising a top surface and a bottom surface;

a seal portion along a perimeter of the body, the seal portion for receiving an edge of a container;

a tear strip removeably connected to the seal portion;

one or more lift tabs accessible upon removal of the tear strip;

a space between each of the one or more lift tabs; and a plurality of protrusions protruding from the bottom surface of the body to a particular depth, wherein:

the body includes four regions defined by two perpendicular axes, each axis of the two perpendicular axes passing through a central point of the body;

the plurality of protrusions are arranged such that at least two of the plurality of protrusions are within each of the four regions and the at least two protrusions in each region are spaced such that a fluid can pass between the at least two protrusions;

each of the plurality of protrusions has a length greater than the particular depth;

a centerline along a longest portion of each protrusion of the plurality of protrusions is parallel to one of the axes; and any protrusion within one of the four regions is perpendicular to any protrusion within an adjacent region of the four regions.

15. The container lid of claim 14, wherein the container lid further comprises a cover panel groove defined by the top surface, the cover panel groove comprising a sloping portion that slopes downwardly to a centerline of the cover panel groove.

16. The container lid of claim 15, wherein the container lid further comprises one or more lead-in features, each of the one or more lead-in features comprising a downward slope from a top portion of the respective lead-in portion to the top surface.

17. A container lid comprising:

a seal portion along a perimeter of a substantially rectangular-shaped body, the seal portion for receiving an edge of a container;

a tear strip removeably connected to the seal portion;

one or more lift tabs accessible upon removal of the tear strip;

a corner window, wherein the corner window is defined by the seal portion and exposes an interior area of the seal portion; and a plurality of protrusions protruding from a bottom surface of the body to a particular depth, wherein:

the body includes four regions defined by two perpendicular axes, each axis of the two perpendicular axes passing through a central point of the body;

the plurality of protrusions are arranged such that at least one of the plurality of protrusions are within each of the four regions;

each of the plurality of protrusions has a length greater than the particular depth; and the length of any protrusion within one of the four regions is perpendicular to the length of any protrusion within an adjacent region of the four regions.

* * * * *